US010556326B1

(12) United States Patent
Kelly

(10) Patent No.: US 10,556,326 B1
(45) Date of Patent: Feb. 11, 2020

(54) SPEED CLAMP FOR T-SLOTTED STRUCTURAL ELEMENTS

(71) Applicant: Voytas Inc., Syracuse, NY (US)

(72) Inventor: Michael T. Kelly, Syracuse, NY (US)

(73) Assignee: Voytas Inc, Syracuse, NY (US)

( * ) Notice: Subject to any disclaimer, the term of this patent is extended or adjusted under 35 U.S.C. 154(b) by 265 days.

(21) Appl. No.: 15/876,787

(22) Filed: Jan. 22, 2018

Related U.S. Application Data

(63) Continuation-in-part of application No. 15/640,998, filed on Jul. 3, 2017, now Pat. No. 10,302,249.

(60) Provisional application No. 62/493,543, filed on Jul. 8, 2016.

(51) Int. Cl.
*B25B 5/16* (2006.01)
*B25B 5/10* (2006.01)
*B25H 1/18* (2006.01)

(52) U.S. Cl.
CPC ..... *B25B 5/166* (2013.01); *B25B 5/10* (2013.01); *B25H 1/18* (2013.01)

(58) Field of Classification Search
CPC ..... B25H 1/0028; B25H 1/02; B25H 1/18; B25B 5/166; B25B 5/10; B23D 45/021; F16M 13/022; F16B 2/12; F16H 19/06; F16H 25/20
USPC ..... 269/43
See application file for complete search history.

(56) References Cited

U.S. PATENT DOCUMENTS 496,498 A * 5/1893 Walker ..... B25B 1/08 269/197
884,772 A * 4/1908 Sorensen ..... F16B 2/12 248/229.12
1,998,597 A * 4/1935 Stuart ..... B25B 5/006 269/89
2,568,233 A * 9/1951 Hamilton ..... B25B 5/003 269/43
3,096,110 A * 7/1963 Cantor ..... F16B 7/0493 403/385
3,449,992 A * 6/1969 Hanaway ..... B23D 59/006 83/455
3,465,995 A * 9/1969 Whitman ..... F16B 2/12 248/228.3
3,469,810 A * 9/1969 Dorris ..... F16B 2/12 248/228.3
4,323,226 A * 4/1982 Close ..... B25B 1/106 248/220.43
4,530,493 A * 7/1985 Break ..... F16B 37/046 269/93

(Continued)

*Primary Examiner* — George B Nguyen
(74) *Attorney, Agent, or Firm* — Maine Cernota & Rardin

(57) ABSTRACT

A clamp for a T-slotted structural element can be positioned anywhere along the T-slot. A housing and stop are oppositely attached to the structural member, and a horizontal shaft is engaged with the housing. A fixing pin is inserted through a vertical hole in the housing and attached to a slot key that is inserted in the T-slot. Actuating a lever or handle applies an upward force on the fixing pin, pressing the key against the top of the T-slot and fixing the housing in place. In embodiments, the stop can be repositioned to any of a plurality of locations along the T-slot. In certain embodiments, the stop and housing can be placed on different surfaces of the structural member. In various embodiments, the stop and/or housing are constructed with different slot profiles that match their respective T-slotted structural elements. In embodiments, the housing is rotatable.

16 Claims, 26 Drawing Sheets

(56) References Cited

U.S. PATENT DOCUMENTS 4,598,574 A * 7/1986 Hegel ..... B21D 37/14 269/60
4,704,829 A * 11/1987 Baumker, Jr. ..... E04B 7/022 269/43
4,772,000 A * 9/1988 Aubert ..... B25B 1/2473 269/137
5,427,364 A * 6/1995 Zborschil ..... B25B 5/102 269/166
5,477,598 A * 12/1995 Borner, Jr. ..... B25B 27/0035 254/10.5
5,527,016 A * 6/1996 Wilkerson, Jr. .... E04F 11/1804 182/113
5,722,649 A 3/1998 Morris
5,898,974 A * 5/1999 Boyer ..... F16B 37/0857 16/114.1
6,067,693 A * 5/2000 Chen ..... B25B 5/068 24/514
6,092,797 A * 7/2000 You ..... B25B 1/125 269/181
6,113,085 A * 9/2000 Lindenthal ..... B25B 5/102 269/170
6,394,438 B1 * 5/2002 Glaser ..... B25B 1/103 269/282
6,431,534 B1 * 8/2002 Orosz ..... B25B 5/101 269/249
6,474,632 B1 * 11/2002 Liou ..... B25B 5/068 269/170
6,550,128 B1 * 4/2003 Lorenz ..... E21B 19/155 166/77.51
6,568,667 B1 * 5/2003 Hall ..... B25B 5/068 269/170
6,622,976 B1 * 9/2003 Ianello ..... F16L 3/13 248/73
6,708,966 B1 * 3/2004 Troudt ..... B25B 5/067 269/249
7,040,609 B1 * 5/2006 Liou ..... B25B 5/068 269/3
7,093,828 B2 * 8/2006 Murray ..... B25B 5/067 269/6
7,421,768 B2 * 9/2008 Chiang ..... B25B 11/02 269/43
8,210,510 B2 * 7/2012 Li ..... B25B 1/103 269/246
8,991,802 B1 * 3/2015 Southworth ..... B66F 19/00 269/43
9,393,089 B1 * 7/2016 Al-Shehri ..... F16B 2/065
10,302,249 B1 * 5/2019 Kelly ..... B25H 1/04
2001/0050456 A1 * 12/2001 Wallis ..... B25B 5/145 269/43
2002/0101017 A1 * 8/2002 Kolarik ..... B25B 27/10 269/43
2003/0042662 A1 * 3/2003 Ternel ..... B25B 5/006 269/43
2006/0108729 A1 * 5/2006 Siegel ..... B25B 1/08 269/266
2007/0057424 A1 * 3/2007 Kern ..... B25B 5/003 269/6
2007/0132165 A1 * 6/2007 Hughes ..... B25B 5/068 269/6
2007/0222130 A1 * 9/2007 Leinbach ..... B25B 5/068 269/6
2008/0023608 A1 * 1/2008 Hsieh ..... A47F 5/0853 248/307
2008/0217830 A1 * 9/2008 Roesch ..... B25B 5/102 269/246
2009/0008850 A1 * 1/2009 Liou ..... B25B 1/125 269/166
2012/0219354 A1 * 8/2012 Bauer ..... F16B 2/12 403/187
2015/0283679 A1 * 10/2015 Ursell ..... B25B 5/166 269/149
2015/0311606 A1 * 10/2015 Meine ..... F16B 2/12 439/100
2017/0291281 A1 * 10/2017 Tsui ..... B25B 5/142
2018/0107094 A1 * 4/2018 Yowler ..... G03B 15/02

* cited by examiner

FIG.11
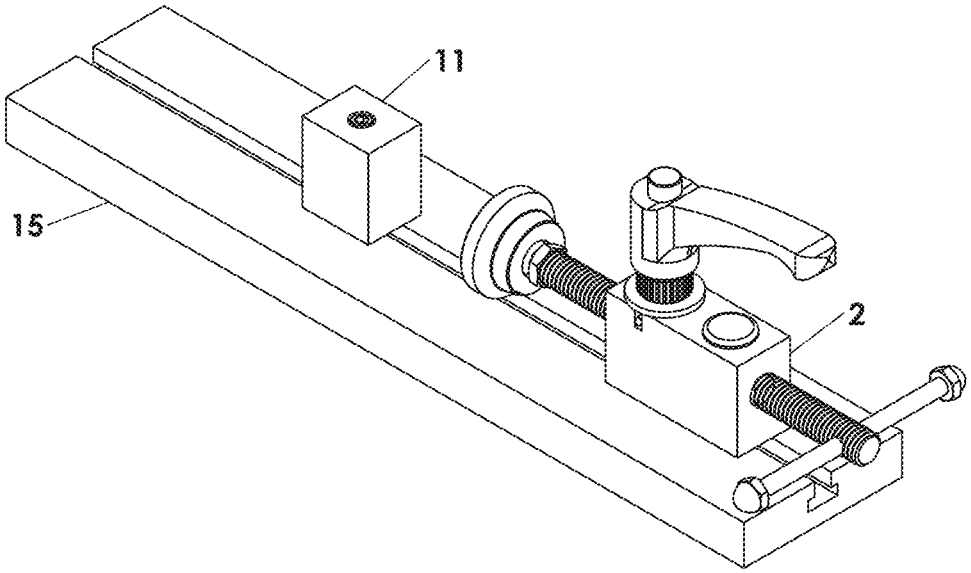
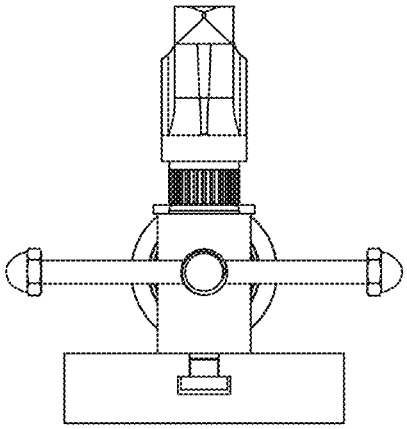
FIG.12
FIG.13
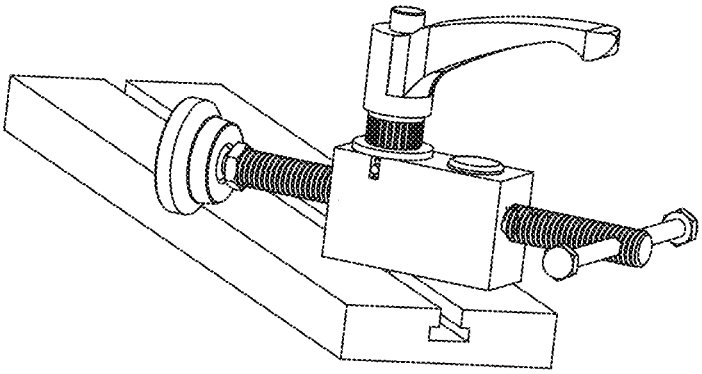

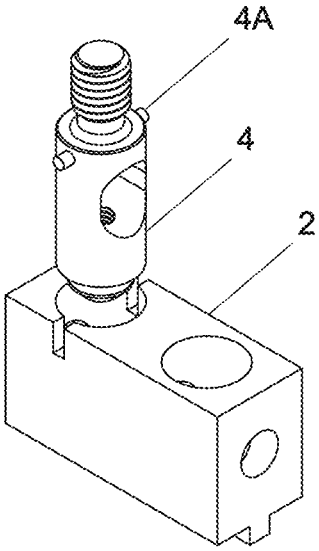
FIG.19
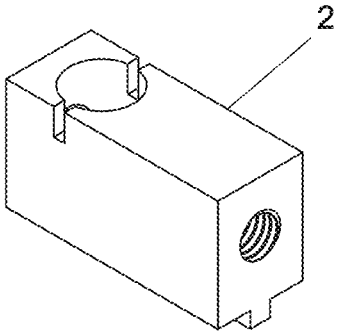
FIG.20
FIG.21
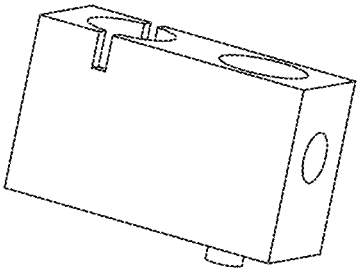

ACTUATOR USING STRUT CHANNEL

ACTUATOR WITH EXPLODED DRIVE END VIEW

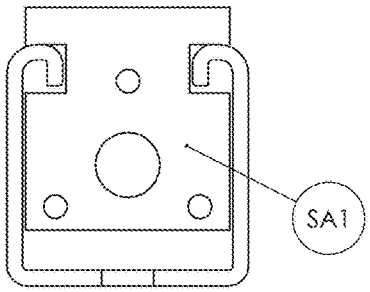
FIG. 30A
END VIEW
OF CARRIAGE
INSIDE STRUT CHANNEL
FIG. 30B
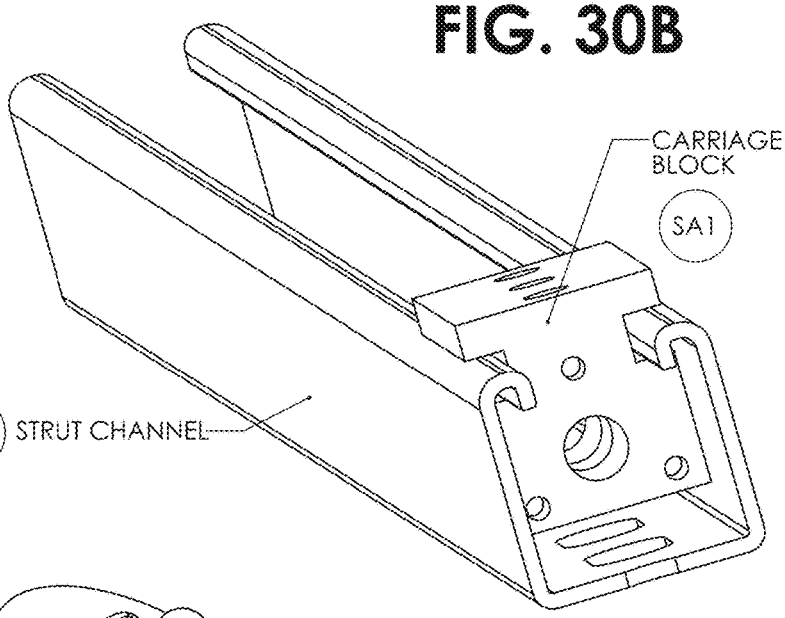
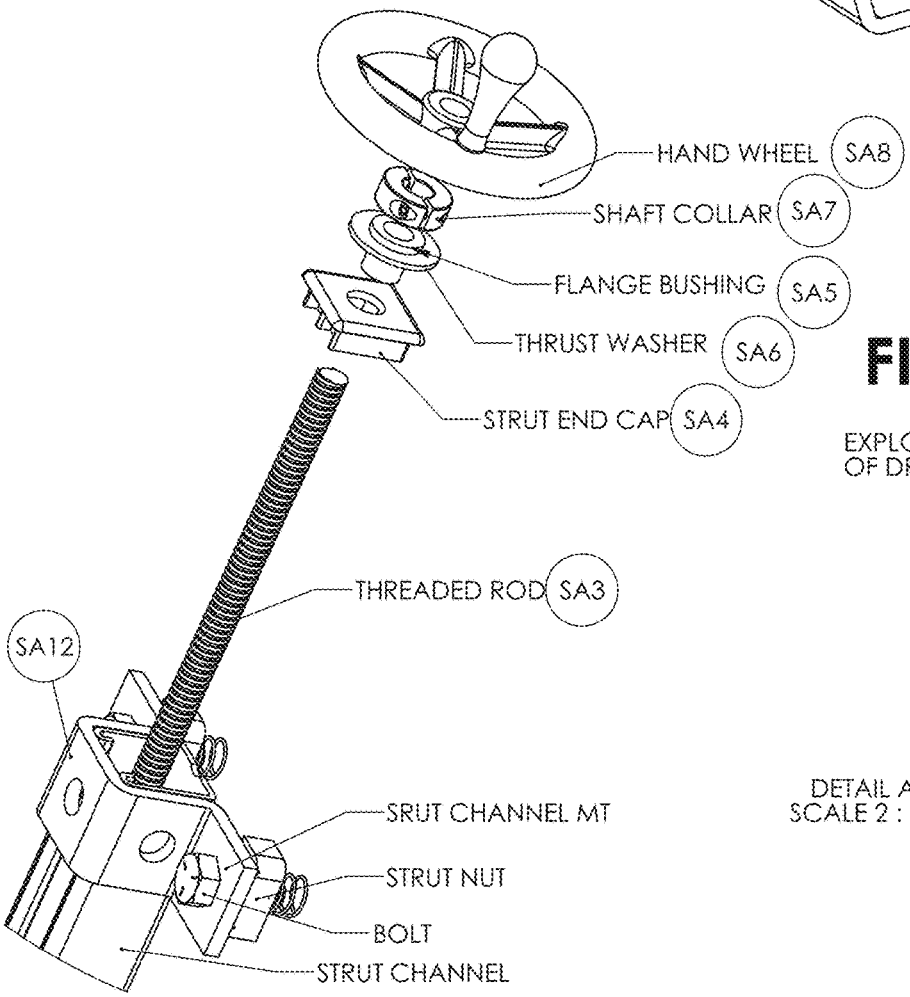
FIG. 31
EXPLODED VIEW
OF DRIVE END
DETAIL A
SCALE 2 : 4.5

DUAL CARRIAGE
WITH SELF CENTERING
CARRIAGE TRAVEL

HEX NUT DRIVE

ZERO BACK LASH NUT DRIVE

TAPPED CARRIAGE BLOCK

BELT DRIVEN LINEAR ACTUATOR

STRUT PANEL SAW

DETAIL OF COUNTER BALANCE

DETAIL A
SCALE 1 : 3

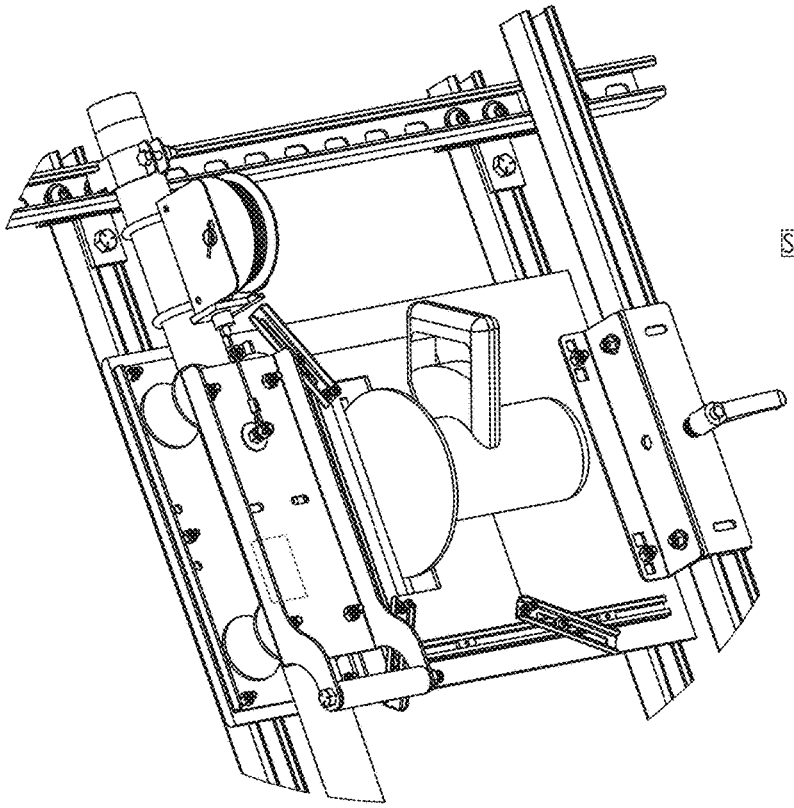
FIG. 39
SAW CARRIAGE DETAIL
DETAIL B
SCALE 1 : 6
FIG. 40
SAW CARRIAGE DETAIL
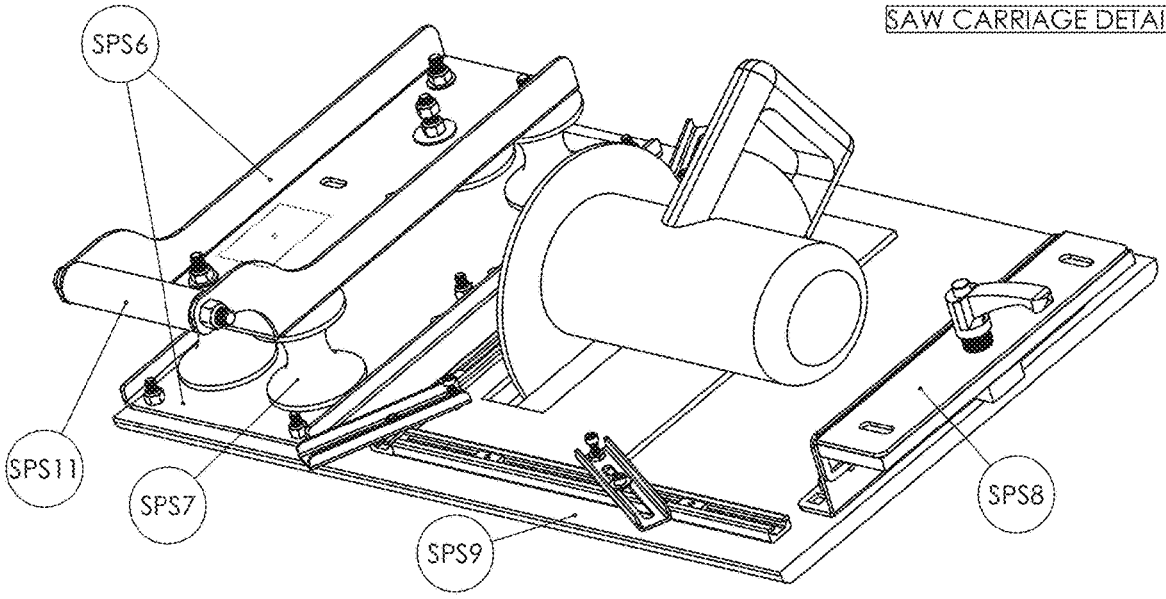

DETAIL C
SCALE 1 : 4

PANNEL SUPPORT ROLLER ASSEMBLY

PANNEL SUPPORT ROLLER ASSEMBLY

STRUT CHANNEL FOLDING BENCH

STRUT FOLDING BENCH IN UP/RAISED POSITION

DETAIL OF FOLDING BENCH BRACE

SPEED CLAMP FOR T-SLOTTED STRUCTURAL ELEMENTS

RELATED APPLICATIONS

This application is a continuation in part of U.S. patent application Ser. No. 15/640,998 filed Jul. 3, 2017. Application Ser. No. 15/640,998 claims the benefit of U.S. Provisional Application No. 62/493,543, filed Jul. 8, 2016, which is herein incorporated by reference in its entirety for all purposes.

FIELD OF THE INVENTION

The invention relates to mechanical clamps, and more particularly, to mechanical clamps that are mounted to a structural member.

BACKGROUND OF THE INVENTION

Slotted structural elements that are used in the construction and electrical industries for light structural support, often for supporting wiring, plumbing, or mechanical components such as air conditioning or ventilation systems.

One, less expensive type of slotted structural element is a channeled strut, which is usually formed from metal sheet, folded over into an open channel shape with inward-curving edges to provide additional stiffness and as a location to mount interconnecting components. Struts can also be constructed from fiberglass. Struts sometimes have holes of some sort in their bases, to facilitate interconnection or fastening of the struts to underlying building structures.

For more mechanically demanding applications, extruded structural elements are often used. For example, aluminum can be extruded to form slotted structural members having various precise shapes and sizes, including structural elements that include slots formed in more than one longitudinal surface.

One common variety of slotted structural element is the "T-slotted" structural element, where the term "T-slotted" is used to refer to any structural element that is uniform in cross section along its length and includes at least one longitudinal slot that is open to a surface of the structural element, and is widened below the surface so that the slot is covered by an overhang on each side. T-slotted plates, bars, T-slotted extrusions and table surfaces are used in a wide variety of industries. Entire frameworks for machinery are constructed using many different sizes and shapes of T-slot elements. Metal and wood working equipment incorporate T-slotted tables/work tops to secure work pieces while machining, grinding, welding and performing other processes. These T-slotted elements are made from steel, aluminum, plastic and fiber glass.

A T-slotted extrusion is so-called because it has a groove or slot in the shape of an inverted letter "T" cast, extruded, machined or planed in the upper surface of its structure. T-slotted extrusions can take the shape of a table, plate, bar or tube with an undercut below the top plane. In the aluminum structural frame industry, the groove or slot can be found on all sides of a slotted extrusion. The combined slot and undercut results in a shape, from an end view of the member, approximately resembling an inverted block-letter capital T.

An important advantage of using standardized T-slotted structural elements in construction is that there are many options available for rapidly and easily connecting the structural elements together, and for connecting other items to the T-slotted structural elements, using various specialized fasteners and bolts. This allows T-slotted structural elements to be assembled into a desired structure very rapidly, with minimal tools, and with only moderately trained labor, thereby reducing costs significantly for many applications. Typically, an assembly of T-slotted struts or extrusions can also be modified or added onto relatively easily if needed. The only alternative to slotted strut channels and extrusions for most applications is custom fabrication using steel bar stock and other commodity components, requiring welding or extensive drilling and bolting, which has none of the above advantages.

In addition to structural framing for machines, T-slotted structural elements are also used in jigs and assembly fixtures. The T-slots allow components to be bolted anywhere along the length of the structural elements. This allows components to readily locate or hold a part in place while it is being machined or being attached to another part. The installation and adjustment of such slotted components, and the quick disassembly of the same components, provide many variations for other uses. In situations that require a part to be held in position, the need to attach a part holding device or clamp to a T-slotted structural member is necessary. Typically, such clamps have been fixed to the end of the structural member. However, because final adjustments and a variation in the part that needs to be held or clamped is common, it would be advantageous if a clamp could be positioned and re-positioned anywhere along the T-slotted structural element.

Typically, a strut or extrusion clamp includes a compression jaw and an anvil jaw that are arranged in an opposing relationship with each other. The compression jaw is usually located at an end of a structural element, and is typically mounted to a force-creating component, which can be guided by and/or mounted to a variety of materials having a variety of shapes. In many clamps, the force-creating component is a screw that is manually rotated to advance the compression jaw toward the anvil jaw, so as to impart a force on the object to be clamped, which is transmitted from the object to the anvil jaw. Note that the anvil jaw is also referred to herein as the "clamp stop," while the compression jaw and the components that impart the force to the said compression jaw is also referred to herein as the "clamp block."

Unfortunately, traditional clamps used for interconnecting structural members such as strut channels and slotted extrusions suffer from several deficiencies. Typically, the clamp block is rigid and fixed at an end of a structural member, and is not free to move along the structural member. The clamp block is typically threaded to a pipe that is fastened, pinned or ultimately welded to the structural member.

Also, known clamp blocks and clamp stops are typically complex, and require advanced manufacturing techniques to construct, and the number of clamp blocks and clamp stops that can be attached to a given structural member is very limited. In addition, structural members to which clamps are attached are typically dedicated to the function of the clamp and cannot be easily used in other applications, due to the fastening or welding of the clamp components to the said structural member and/or structural changes made to the structural member itself to accommodate the clamps. As a result, other structural members and/or additional accessories are not easily attached to the clamp structure, which limits the function of the clamp.

Known strut clamps also set a lower-limit on the cross-sectional size of the strut channels with which they are compatible, typically requiring U-shaped channels of the larger variety, because smaller or more shallow U-shaped channels do not provide sufficient cross-sectional area for attachment of known clamp designs.

What is needed, therefore, is a clamp for a T-slotted structural element that can be easily and flexibly positioned along the structural member, can be used with slotted structural members of smaller cross-section, and does not require permanent attachment to a pipe, bar, or other structural member.

SUMMARY OF THE INVENTION

The present invention is clamp for a T-slotted structural element that can be easily and flexibly positioned along the structural member, can be used with slotted structural members of smaller cross-section, and does not require permanent attachment to a pipe, bar, or other structural member. In embodiments, the compression and anvil jaws can be attached to any of a plurality of slotted surfaces of the structural member.

Embodiments of the present invention are compatible for use with commercially available T-slotted struts and extrusions, many of which are highly versatile and can be cut to desired lengths with common metal cutting saws. Because embodiments of the invention do not require any customization of the T-slotted structural elements, expensive machine tools are not required. Examples of T-slotted extrusions that are compatible with embodiments of the present invention include, but are not limited to, T-slotted structural elements marketed under the trade names 80/20, Item, and Maytec.

A primary advantage of the present invention is the ability to position the clamp block and clamp stop anywhere on the slotted structural element. Embodiments take advantage of the fact that the open side of a typical T-slotted structural element provides a continuous adjustment slot within which a component can be located.

In a first general aspect of the invention, the clamp block assembly of the disclosed clamp includes a clamp block that is penetrated by at least one vertical positioning hole and by at least one horizontal passage. A fixing pin is inserted through the positioning hole and terminates in a slidable feature that is able to move horizontally within the T-slot channel of a T-slotted structural element, but cannot be pulled vertically out of the T-slot channel. A position fixing mechanism located at an upper end of the fixing pin is able to apply an upward force on the fixing pin, thereby lifting the slidable feature so that it is pressed against the upper surface of the T channel, thereby fixing the clamp block assembly in place. When the upward force is released, the slideable feature is able to slide freely within the T channel, thereby allowing arbitrary location of the clamp block assembly along the longitudinal axis of the T-slotted structural element.

The fixing pin includes a vertically elongated horizontal slot that is aligned with the horizontal passage of the clamp block, so as to allow a clamping shaft to pass entirely through the clamp block. An engagement mechanism that engages the clamping shaft with the clamp block enables the clamping shaft to be incrementally advanced through the clamping block so as to apply a clamping force onto a work piece. Accordingly, when the clamp block is rigidly fixed to the slotted element, the threaded rod is still able to move freely, allowing the clamping action to take place.

In embodiments, the position fixing mechanism applies an upward force on the fixing pin by a cam lever action, while in other embodiments the position fixing mechanism is threaded onto an upper portion of the fixing pin and applies the upward force due to rotation of the position fixing mechanism relative to the fixing pin. In some of these embodiments, a fixing handle is provided to facilitate manual rotation of the position fixing mechanism.

In embodiments, the clamping shaft and horizontal passage are threaded, so that the clamping shaft can be advanced and withdrawn by simple rotation of the clamping shaft. In other embodiments, the clamp block assembly includes a so-called "quick nut" which, when pressed, releases the threaded engagement of the threaded post with the clamp block. In embodiments, the quick nut is configured as disclosed in U.S. Pat. No. 5,898,974.

In embodiments, the body of the clamp block that supports and guides the clamping shaft has a flat bottom, so that the entire clamp block is capable of rotating 360 degrees about the axis of the fixing pin. And in some embodiments the end of the clamping shaft that is closest to the work piece includes a pivoting pad or a clamp stop that does not interfere with sliding of the clamp block along the T-channel of the slotted structural element.

In embodiments, the clamp stop is rigidly secured to the T-slotted structural element. In some embodiments, the clamp stop can be located at any position along the length of the T-slotted structural element.

The present invention is a clamp configured for operation while attached to an elongated structural member having a uniform cross sectional shape along its longitudinal axis, where the structural member includes a longitudinal slot that is open to an upper surface of the structural member, said slot being widened below the upper surface of the structural member so that the slot is covered by a slot overhang on each side thereof. the clamp includes a clamp stop attached to the structural member, the clamp stop including a stop surface at its proximal end that is substantially perpendicular to the longitudinal axis of the structural member, and a clamp block assembly comprising a clamp housing penetrated by a first vertical hole intersected by a horizontal passage, a fixing pin inserted in the first vertical hole, the fixing pin including a vertically extended hole that is held in alignment with the horizontal passage of the clamp housing, a slot key that is horizontally insertable into the slot of the structural member, a lower portion of the slot key being sufficiently wide to prevent vertical removal of the slot key from the slot while an upper portion of the slot key extends vertically through the slot and is attached to a distal end of the fixing pin, the clamp housing being thereby slidably attached to the structural member, a lifting mechanism configured to apply a lifting force to the fixing pin, thereby forcing the slot key vertically upward against the slot overhang and fixing the clamp housing in position along the structural member, and a clamping shaft extending through the horizontal passage and engaged therewith, whereby the clamping shaft can be disengaged or otherwise manipulated for advancement and retraction through the horizontal passage, and a block surface fixed to a distal end of the clamping shaft and substantially perpendicular to the longitudinal axis of the structural member, so that the block surface can be placed in an opposed, parallel relationship to the stop surface when the clamping shaft is parallel to the longitudinal axis of the structural member and the block surface is directed toward the clamp stop.

In embodiments, the lifting mechanism includes a lever that can be actuated so as to apply the lifting force.

In various embodiments, the lifting mechanism includes a rotatable member in threaded engagement with a proximal end of the fixing pin, so that rotation of the rotatable member applies the lifting force. In some of these embodiments, the rotatable member is cooperative with a manually operable handle.

In embodiments, the slot key is attached to the distal end of the fixing pin by threaded engagement.

Some embodiments further include a plurality of replacement fixing pins configured for interchangeable attachment to the distal end of the fixing pin so as to adapt the clamp block assembly for attachment to structural members having slots with respectively differing profile shapes. In certain embodiments, the clamp housing can be rotated about the fixing pin when the lifting force is released.

Various embodiments further include an orienting pin extending downward from the clamp housing into the longitudinal slot, thereby maintaining the horizontal passage in parallel alignment with the longitudinal slot. And in some of these embodiments the orienting pin is retractable, thereby enabling rotation of the clamp housing about the fixing pin when the lifting force is released.

In embodiments, the clamping shaft is engaged with the horizontal passage by a ratchet or pawl mechanism. And in some embodiments the clamping shaft is a threaded shaft and the horizontal passage is a threaded passage, so that the clamping shaft can be advanced and retracted through the threaded passage by rotation and counter-rotation of the threaded shaft, respectively.

In various embodiments, the clamping shaft is a threaded shaft, the clamp housing includes a second vertical hole intersecting the horizontal passage, the clamp further comprises a spring resting on a bottom of the second vertical hole, and a thread-engaging mechanism resting on the spring in the second vertical hole, the thread-engaging mechanism including a partially-threaded, vertically elongated hole aligned with the horizontal passage and configured to engage with the threaded shaft when the spring is not compressed, and to release the threaded shaft when the spring is compressed.

In embodiments, a location of attachment of the clamp stop to the structural member can be selected from among a plurality of available attachment locations on the structural member. In some embodiments, the clamp is configured for attachment to a structural member that is a T-slot strut channel formed by folding of a metal sheet. In various embodiments, the clamp is configured for attachment to a structural member that is a slotted extrusion.

And in certain embodiments, the clamp housing extends into the longitudinal slot, thereby maintaining an alignment between the clamp housing and the longitudinal slot.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

BRIEF DESCRIPTION OF THE DRAWINGS

FIG. 11 displays an embodiment of the invention adapted to a T-slot channel strut 15 of a style that differs from FIGS. 1-10;

FIG. 12 is an end view of FIG. 11;

FIG. 13 shows a perspective view of the embodiment of FIG. 12;

FIG. 19 is a perspective view of a non-rotating embodiment of the clamp housing and fixing pin where the fixing pin includes a small dowel pin inserted into the fixing pin;

FIG. 20 is a perspective view of a clamp housing in an embodiment where the horizontal passage in the housing is threaded to match the thread of the clamping shaft;

FIG. 21 is a perspective view of a clamp housing in an embodiment where the housing includes a round button machined on its bottom surface.

FIGS. 30A and 30B show the relationship of the carriage block (SA1) and the strut channel (SA2) of the actuator of FIG. 28;

FIG. 31 is shows a detail view of the bearing assembly typical of the ends of the strut channel;

FIGS. 39 and 40 show details of the saw carriage of FIG. 37;

DETAILED DESCRIPTION

Figure 1:
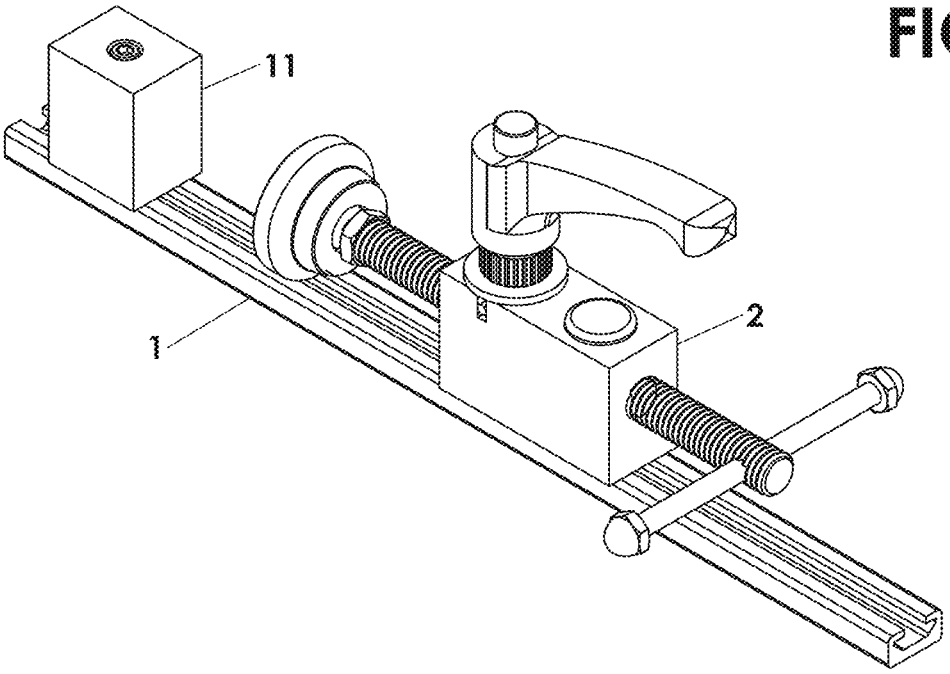
FIG. 1 is a perspective view of an embodiment of the present invention having a clamp block with a smooth, flat bottom surface.

FIG. 1 is a perspective view of an embodiment with a clamp block, also referred to herein as a clamp housing 2, having a smooth, flat bottom surface. The clamp housing 2 and the clamp stop 11 are shown attached to a T-slotted extrusion 1. Other configurations of slotted extrusion are available in the industry, and are compatible with the present invention so long as the slot includes an overhang on both sides thereof. The slotted extrusion shown in this figure is a style that is commercially available from many "T" slot extrusion manufacturers. The "T" style slot allows the clamp housing 2 and clamp stop 11 to be mounted anywhere along the length of the slotted extrusion.

Figure 2:
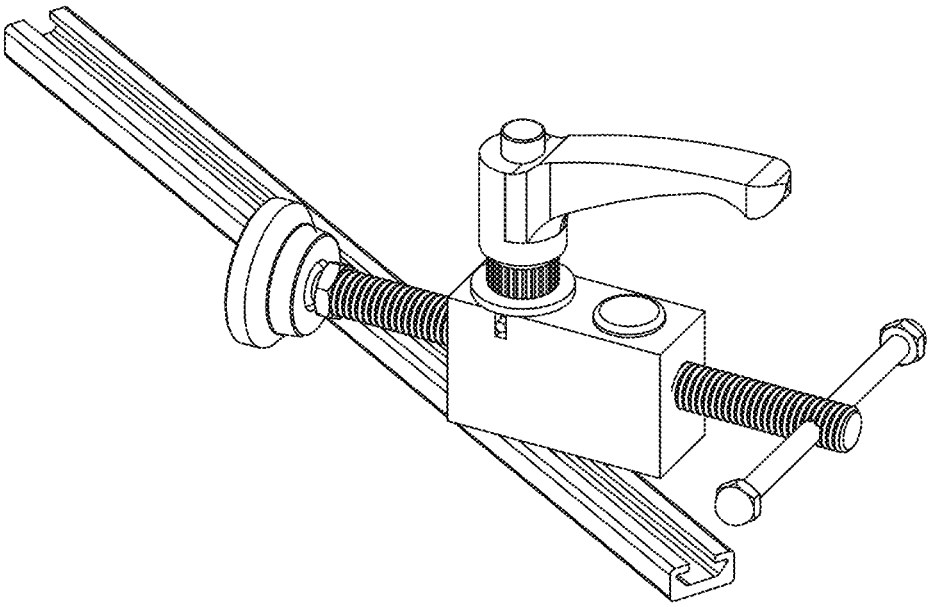
FIG. 2 shows the ability of the clamp housing of FIG. 1 to rotate 360 degrees on a T-slotted structural element.

FIG. 2 shows the ability of the clamp housing 2 of FIG. 1 to rotate 360 degrees on the T-slotted structural element 1.

Figure 3:
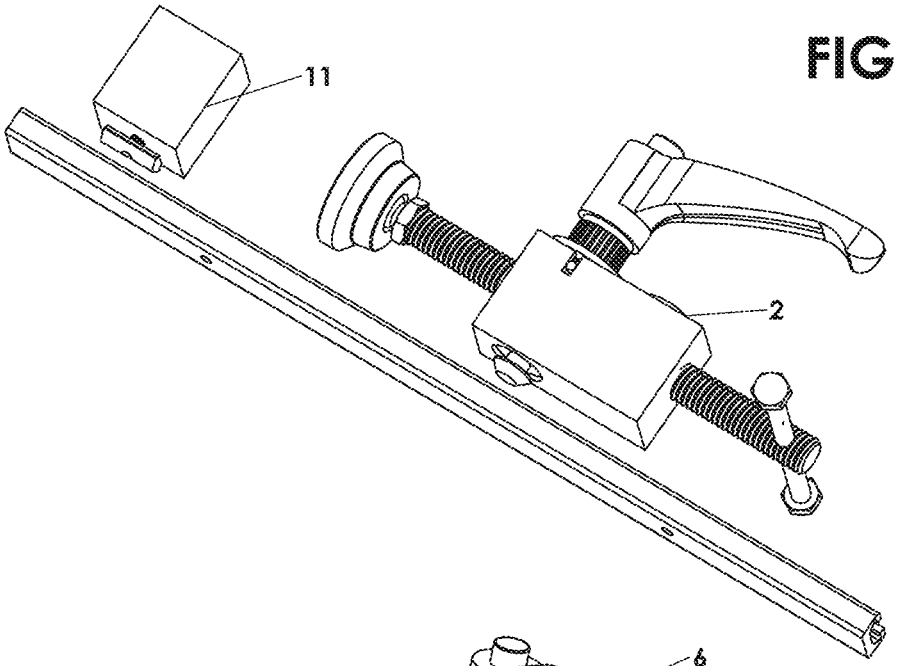
FIG. 3 is a partially exploded view of the embodiment of FIG. 1.

FIG. 3 is a partially exploded view of the embodiment of FIG. 1 showing the flat bottom surface of clamp housing 2 and clamp stop 11.

Figure 4:
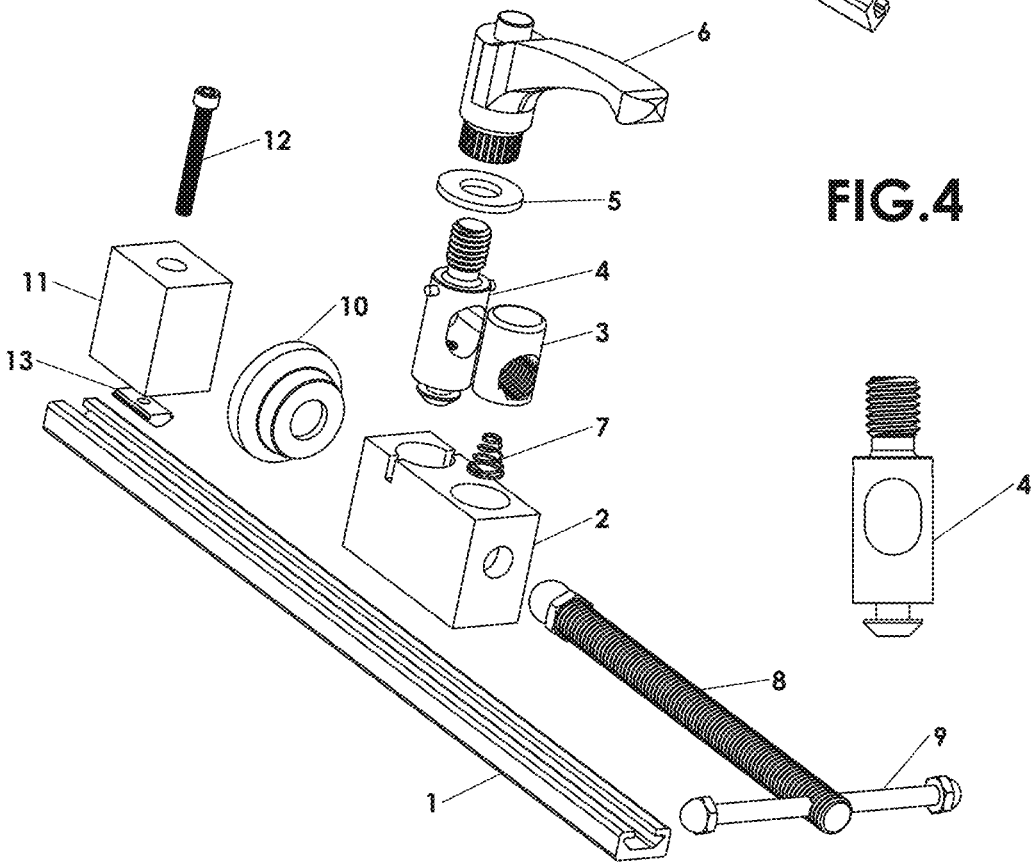
FIG. 4 is an exploded view of FIG. 3.

FIG. 4 is an exploded view of FIG. 3. The clamp housing 2 is the main body of the clamp block assembly. In the illustrated embodiment, the clamp housing 2 has two vertical holes in it. One passes entirely through the clamp housing 2. This hole is for securing the clamp block 2 to the slotted extrusion 1. A lower end of the fixing pin 4 is formed as a "slot key" sliding feature that corresponds to the shape of the T-slotted extrusion 1. The upper end of the fixing pin 4 is threaded. The fixing pin 4 includes a vertically elongated, horizontal slot that allows the pass through of the threaded clamping shaft 8. The fixing pin 4 further includes a horizontal orienting pin that keeps the horizontal slot assigned with the clamping shaft 8.

A second, larger diameter hole in the clamp block 2 is a "blind" hole that does not pass through the block 2. It is a partially bored hole, meaning that it is only partially through the clamp block 2. The bottom of this blind hole is used as a spring seat for the spring 7. This spring exerts a force on a split nut 3 that is inserted in the blind hole. The split nut has an elongated horizontal hole. The lower half of the hole has a threaded section while the upper half has a smooth section. This split nut 3 was adapted from a quick nut registered at the U.S. Pat. No. 5,898,974.

The spring 7 forces the engagement of the threaded portion of the split nut 3 against the threaded clamping shaft 8. Pushing the spit nut 3 down against the spring 7 pushes the threaded portion away from the clamping shaft 8. This allows the threaded shaft 8 to be pushed or pulled through the clamp housing 2 and fixing pin 4 along the length of the clamp housing 2. A threaded shaft T bar 9 is included for manual rotation of the clamping shaft 8, and is free to slide through a hole in the clamping shaft 8. This allows the turning of the clamping shaft 8 anywhere along the slotted extrusion 1 as it will not be hindered by T-slotted extrusion below it. The end of clamping shaft 8 has a swivel cap 10 pressed onto it. This provides a contact surface for the work piece. The illustrated ball joint design provides a non-marring feature that will not damage the work piece to be clamped.

The work piece to be clamped is placed between the face of the swivel cap 10 and the surface of the clamp stop 11. The clamp stop 11 is secured to the T-slotted extrusion using an extrusion nut 13 and a socket head cap screw 12. The clamp stop 11 can be located anywhere along the T-slotted extrusion 1 and locked in place by tightening the socket head cap screw 12 which will draw up the extrusion nut against the inside of the "T" slot groove of the T-slotted extrusion 1. Turning the clamping shaft 8 against the work piece and against the clamp stop 11 will provide a clamping force.

Figure 5:
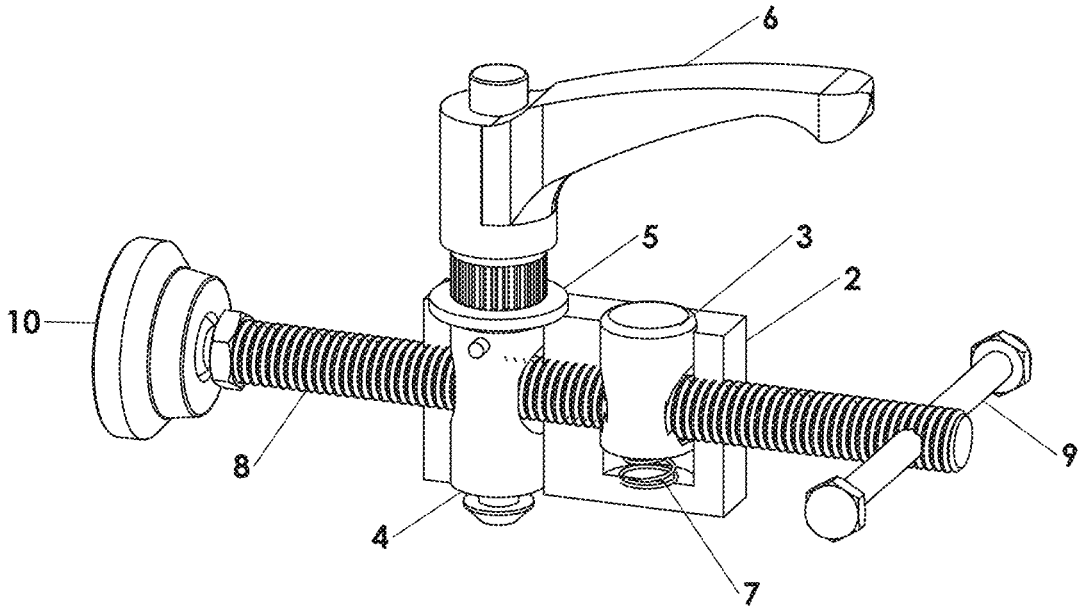
FIG. 5 is a perspective view of the clamp block assembly of FIG. 4 shown with the clamp housing cut away.

FIG. 5 is a perspective view of the clamp block assembly of FIG. 4 shown with the clamp housing 2 cut away showing the blind vertical hole, the position of the split nut 3 and spring 7. The bottom of the blind hole provides a spring seat for spring 7.

Figure 6:
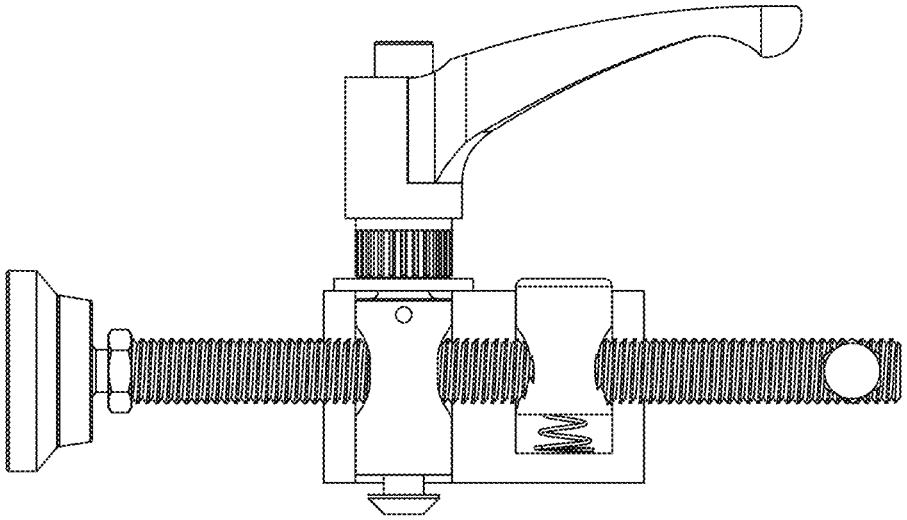
FIG. 6 is a side view of FIG. 5.

FIG. 6 is a side view of FIG. 5.

Figure 7:
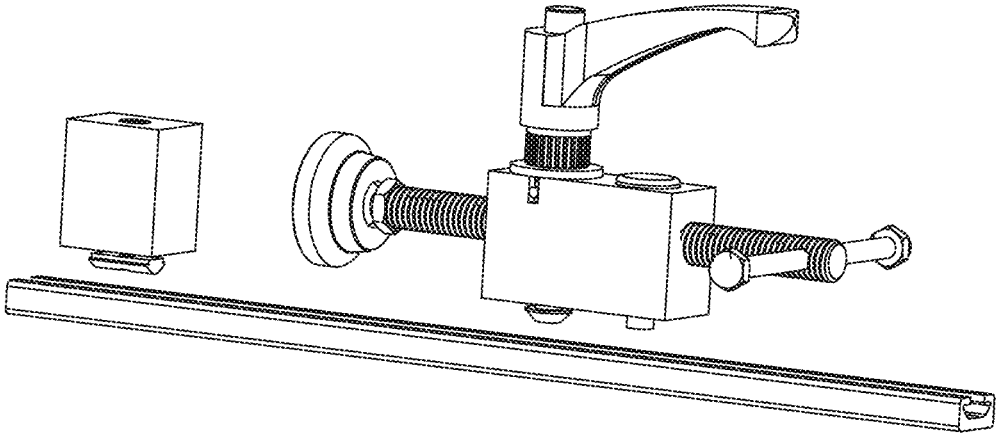
FIG. 7 is a partially exploded view of an embodiment similar to FIG. 1 but in which a locater pin extends below the bottom of the clamp block 2 and into the T channel.

FIG. 7 is a partially exploded view of an embodiment similar to FIG. 1 but in which a locater pin 14 extends below the bottom of the clamp block 2 and into the T channel, thereby preventing rotation of the clamp block 2. In this embodiment, the vertical hole that contains the split nut 3 is partially blind, in that it terminates in a smaller hole that extends through the clamp block 2.

Figure 8:
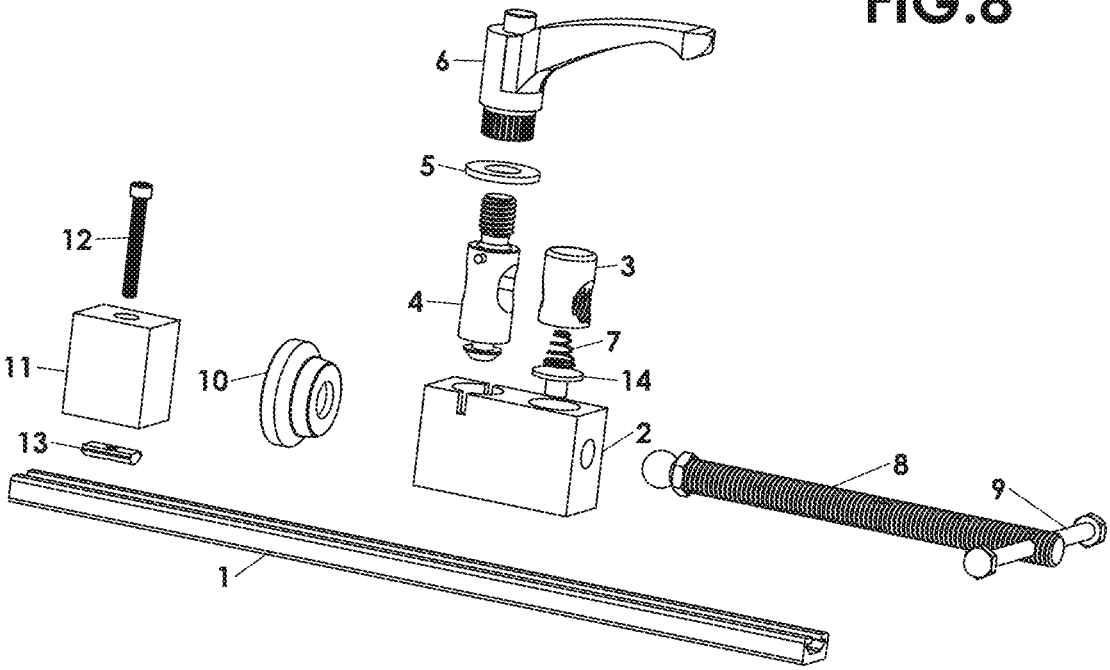
FIG. 8 is an exploded view of FIG. 7.

FIG. 8 is an exploded view of FIG. 7. It can be seen in the figure that a spring locator pin 14 is inserted in the smaller stepped bore hole of the clamp housing 2. The locator pin 14 has a large flange on one end and a small pin step below it. The larger flange of the locator pin 14 provides a surface for spring 7 to rest against. The pin step of locator pin 14 is inserted in the smaller step bore hole of the clamp housing 2, whereby the locater pin 14 extends below the flange and through an opening in the bottom of the partially blind hole.

Figure 9:
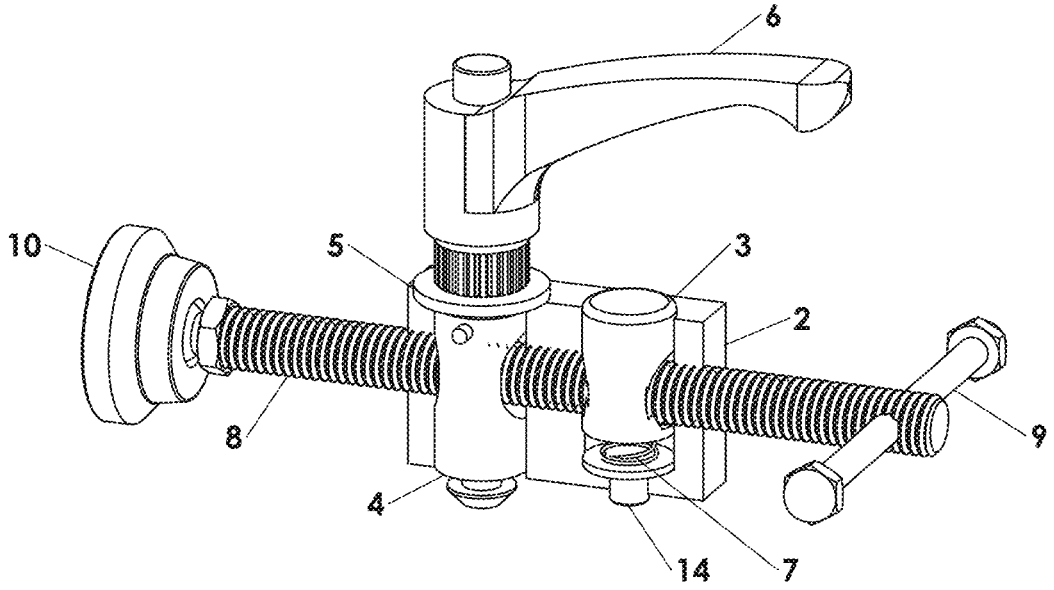
FIG. 9 is a perspective view of the clamp block of FIG. 8 with the clamp housing 2 cut away.

FIG. 9 is a perspective view of the clamp block of FIG. 8 with the clamp housing 2 cut away showing the position of the locator pin 14, the split nut 3 and spring 7. The larger diameter flange of locator pin 14 provides a spring seat for spring 7.

Figure 10:
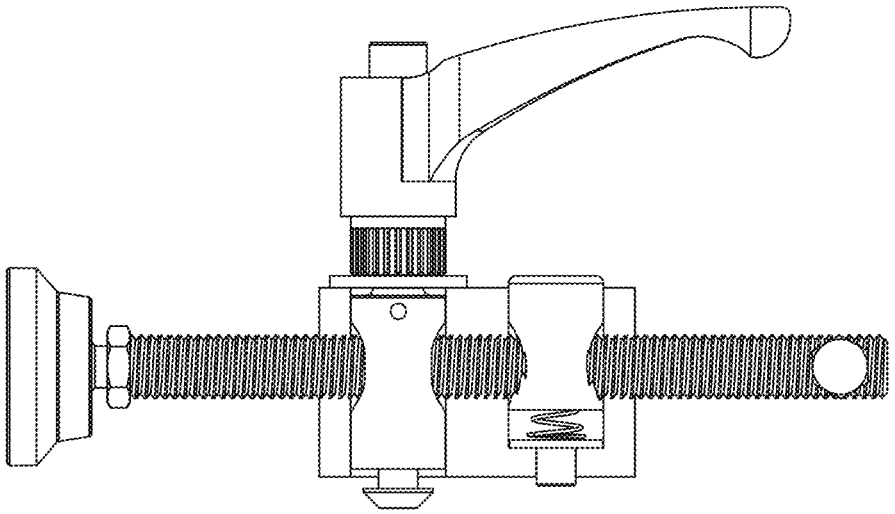
FIG. 10 is a side view of FIG. 9.

FIG. 10 is a side view of FIG. 9. In this view, the smaller step of locator pin 14 is extending past the bottom surface of clamp housing 2. The engagement of the locator pin 14 in the "T" slot groove is also shown in FIG. 12.

FIG. 11 displays an embodiment of the invention adapted to a T-slot channel strut 15 of a style that differs from FIGS. 1-10.

FIG. 12 is an end view of FIG. 11. This view shows the "T" style slot of the extrusion in its true form.

FIG. 13 shows a perspective view of the embodiment of FIG. 12. This view demonstrates the ability of the clamp block 2 to rotate 360 degrees along the T-slotted extrusion.

It can be seen in FIGS. 8-13 that the locator pin 14 is free to move up and down in the small step bore of the clamp housing 2. When the clamp block 2 is in the position shown in FIG. 13, the pin step of locator pin 14 is pushed up into the clamp housing 2. This allows the clamp block 2 to be rotated freely about the fixing pin when the fixing pin is loosened. When the clamp block 2 is required to be positioned in the direction of the slot of the extrusion 15, as shown in FIG. 11, the step pin of the locator pin 14 drops into the "T" profile slot of the extrusion 15. This helps keep the clamp assembly in line and pointing in the same direction as the longitudinal axis of the extrusion 15.

Figure 14:
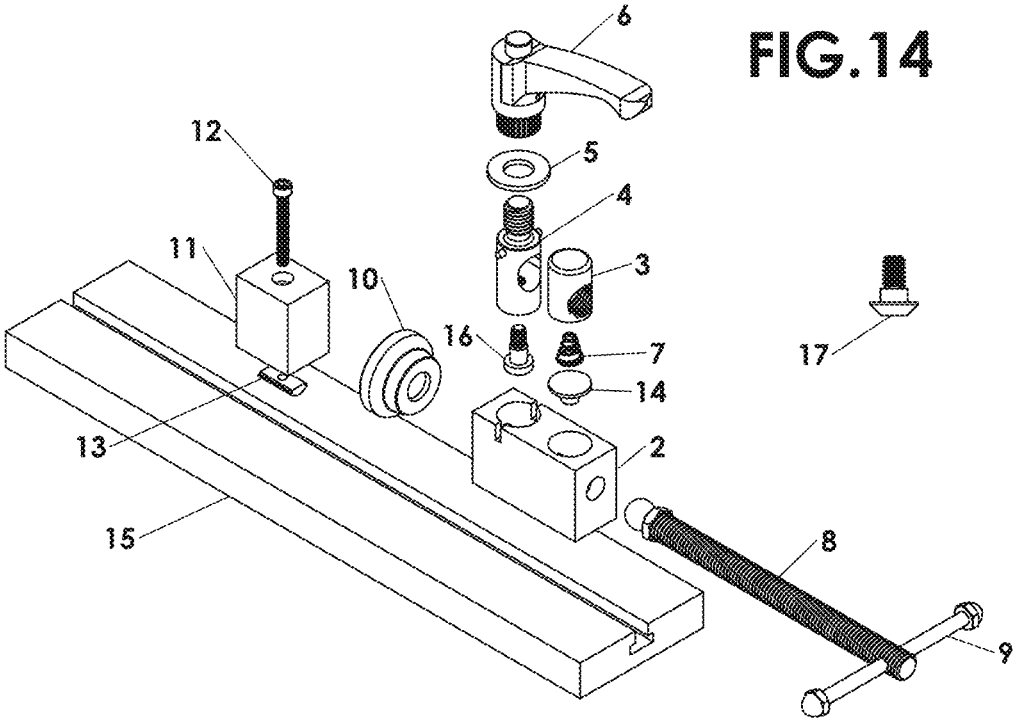
FIG. 14 shows an exploded view of the clamp block and clamp stop of FIG. 13.

FIG. 14 shows an exploded view of the clamp block and clamp stop of FIG. 13. The assembly of 16,4,5,6 is what secures the clamp housing 2 in position on the T-slotted extrusion. In this embodiment, the "slot key" is a separate, threaded button 16 that is attached to the bottom of the fixing pin 4. When the lock handle 6 is tightened, it draws the threaded pin 4 upward, and thereby forces the round head of the threaded button 16 against the inside of the "T" slot of the extrusion. The threaded attachment of the button 16 to the fixing pin 4 allows the clamp to be adapted to a second T-slotted extrusion simply by providing a second threaded button 17 having a head shape adapted to the second T channel profile. An assortment of replacement threaded buttons 17 suitable for exchange with the first threaded button 16 can be included in the embodiment, thereby allowing the clamp to be used on many different T-slotted extrusions. The replacement threaded button 17 shown in the figure is shaped to fit within the T-slotted extrusion 1 in FIG. 4

Figure 15:
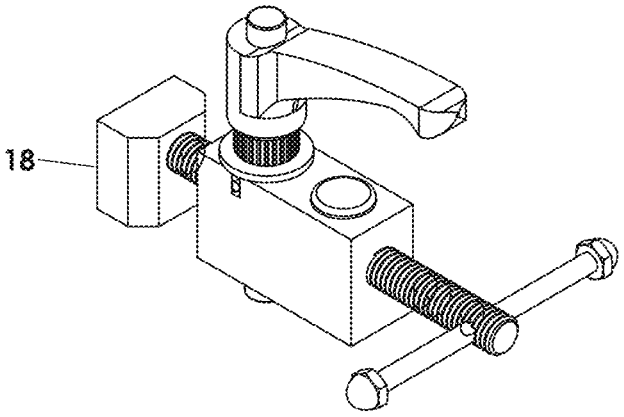
FIG. 15 shows an embodiment similar to FIG. 14, but including a clamp pusher instead of a swivel cap.

FIG. 15 shows an embodiment similar to FIG. 14, but including a clamp pusher 18 instead of a swivel cap 10. This clamp pusher 18 is unable to swivel or pivot at the end of the clamping shaft 8. The clamp pusher 18 does not have a ball end socket but rather a straight internal bore that matches the turned down end of the clamping shaft 8 in FIG. 15.

Figure 16:
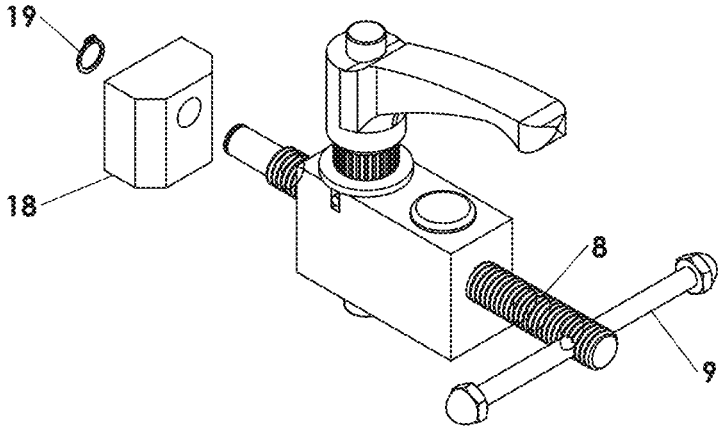
FIG. 16 illustrates an embodiment in which the clamp pusher is secured to the end of the clamping shaft by a snap ring.

As shown in FIG. 16, the clamp pusher 18 is secured to the end of the clamping shaft 8 by a snap ring 19.

Figure 17A:
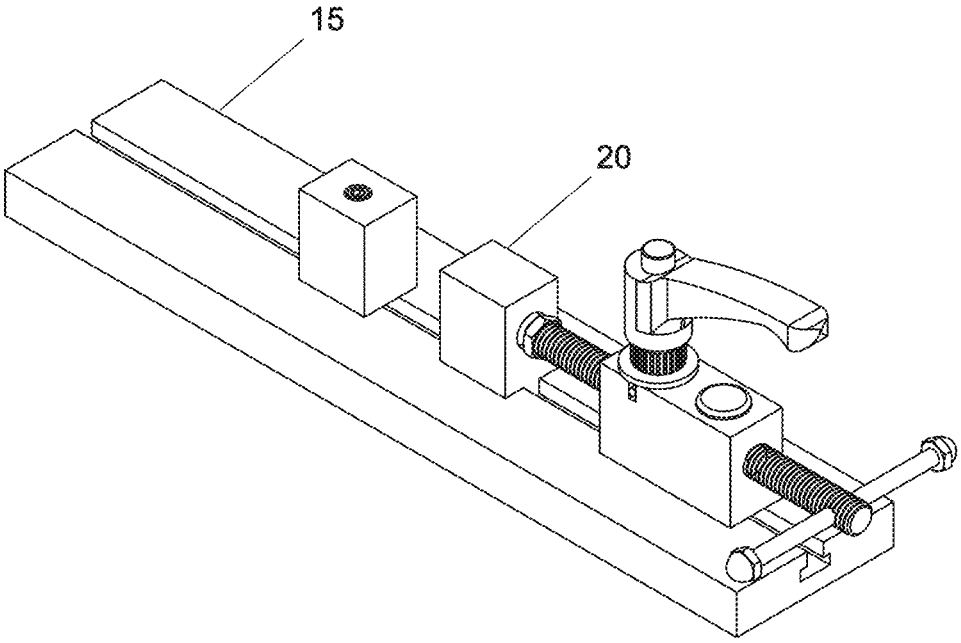
FIG. 17A is a perspective view of an embodiment that includes a ball joint socket ended clamp pusher.
Figure 17B:
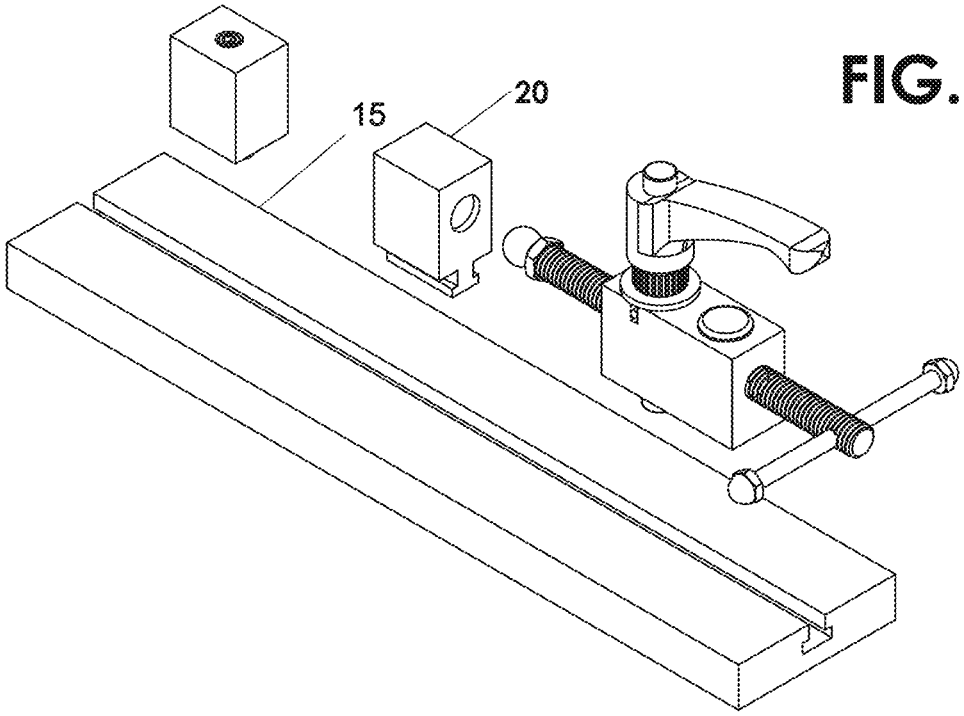
FIG. 17B illustrates that in the embodiment of FIG. 17A the bottom of the ball joint socket clamp pusher has a shape that matches the "T" slot groove of T-slotted extrusion.

FIG. 17A is a perspective view of an embodiment that includes a ball joint socket ended clamp pusher 20. The bottom of the ball joint socket clamp pusher 20 has a shape that matches the "T" slot groove of T-slotted extrusion 15 as shown in FIG. 17B. This shape keeps the ball joint socket ended clamp pusher 20 in the "T" slot groove, preventing it from lifting out of the groove.

Figure 18A:
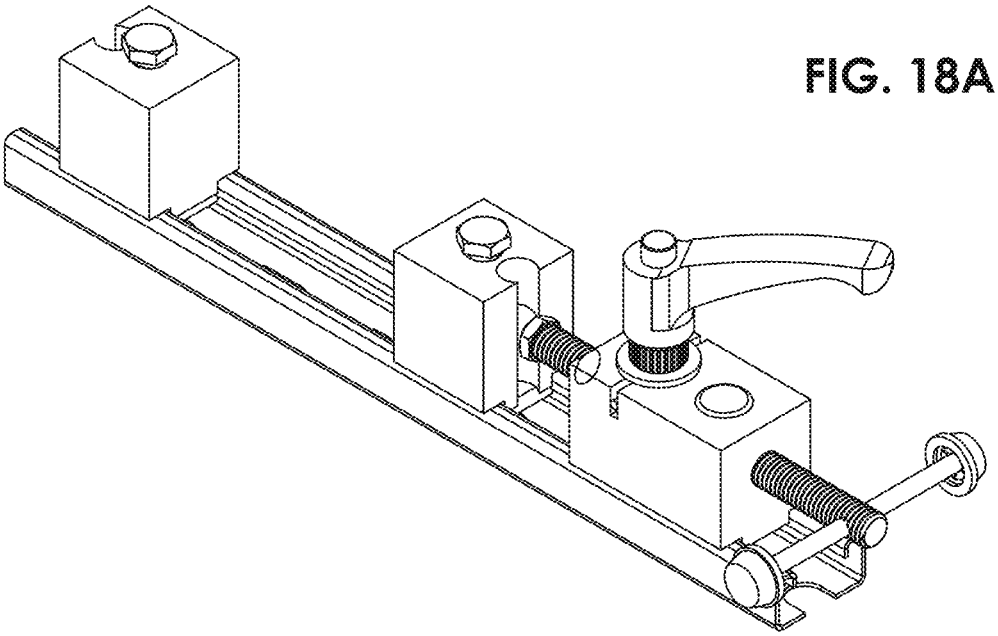
FIG. 18A is a perspective view of an embodiment similar to FIG. 17A, but attached to a strut channel rather than a slotted extrusion.
Figure 18B:
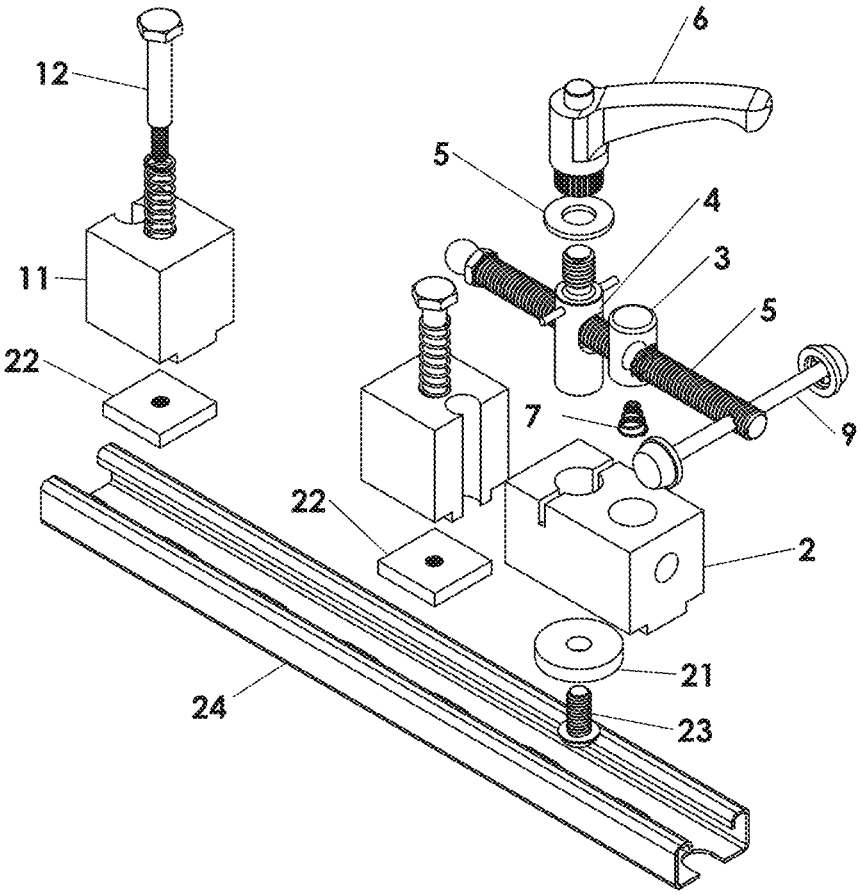
FIG. 18B is an exploded view of the embodiment of FIG. 18A.

FIG. 18A is a perspective view of an embodiment similar to FIG. 17A, but attached to a strut channel rather than a slotted extrusion. FIG. 18B is an exploded view of the embodiment of FIG. 18A. It can be seen in the figures that the illustrated embodiment includes flat washers 21-23 inserted as slot keys into the T-slot of the strut channel 24 rather than the threaded buttons 16 that are inserted in other embodiments into T-slots of extrusions 15.

FIG. 19 is a perspective view of a non-rotating embodiment of the clamp housing 2 and fixing pin 4 where the fixing pin 4 includes a small dowel pin 4A inserted into the fixing pin 4.

FIG. 20 is a perspective view of the clamp housing 2 in an embodiment where the horizontal passage in the housing 2 is threaded to match the thread of the clamping shaft 8. In this embodiment, the clamp housing 2 has a machined key on the bottom thereof. This machined key is matched in shape with the "T" slot T-slotted extrusion.

FIG. 21 is a perspective view of the clamp housing 2 in an embodiment where the housing 2 includes a round button machined on its bottom surface. This round button is machined so that its shape matches a respective "T" slot T-slotted extrusion.

Figure 22:
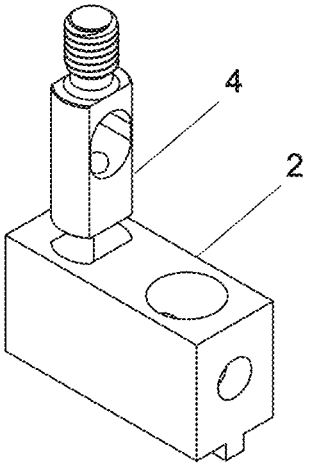
FIG. 22 is a perspective view of a clamp housing in an embodiment where the fixing pin and first vertical hole have flattened sides that prevent rotation of the fixing pin.
Figure 23:
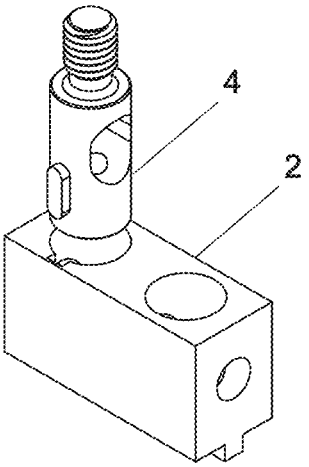
FIG. 23 is a perspective view of a clamp housing in an embodiment where the fixing pin includes an extended key in one side that fits within a vertical slot provided in the vertical hole so as to prevent rotation of the fixing pin.
Figure 24:
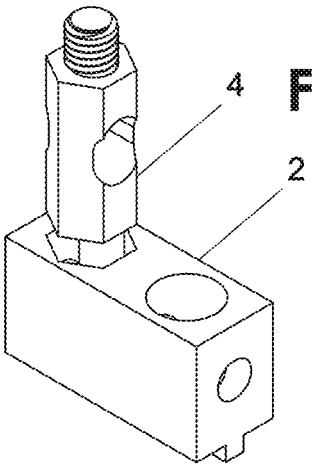
FIG. 24 is a perspective view of a clamp housing in an embodiment where the fixing pin and first vertical hole have polygon shapes that prevent rotation of the fixing pin.

FIGS. 22-24 display clamp housings 2 and fixing pins 4 in other embodiments that prohibit the rotation of the fixing pin 4. In these embodiments, a lock handle 6 is threaded on an external threaded end of fixing pin 4.

Figure 25:
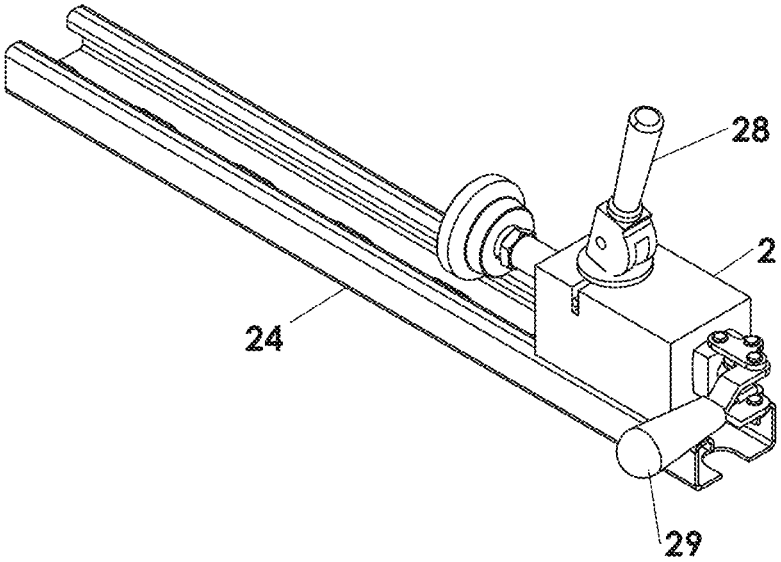
FIG. 25 is a perspective view of an embodiment that includes a cam lever mechanism that impart an upward force to the fixing pin.

FIG. 25 illustrates an embodiment having a clamp housing 2 that uses a cam lever 28 to secure the clamp housing 2 to a strut channel 24. The force producing member that advances the clamping shaft 8 in this embodiment incorporates a toggle lever mechanism 29.

Figure 26:
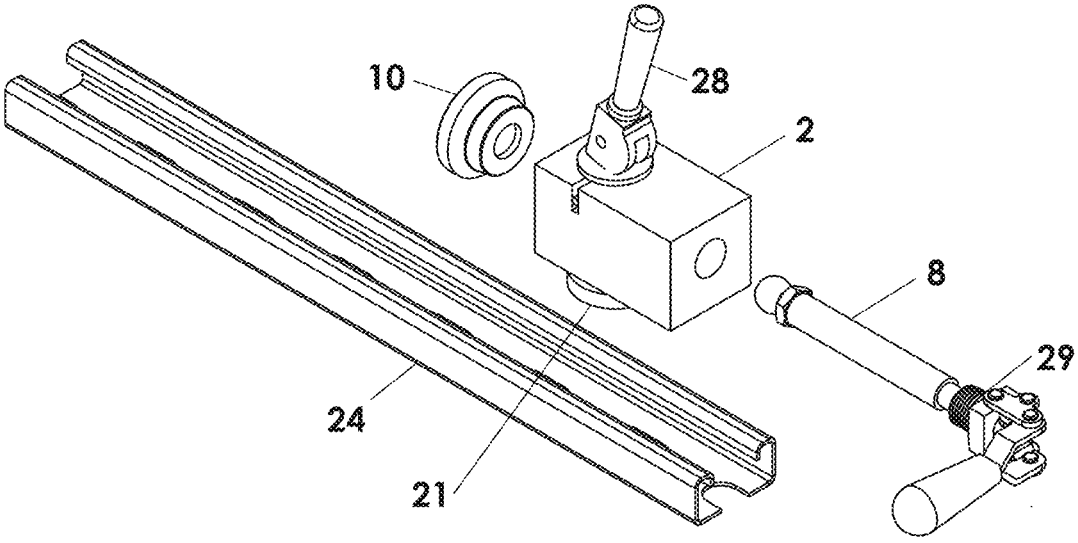
FIG. 26 is an exploded view of the embodiment of FIG. 25

FIG. 26 is a partially exploded view of FIG. 25. The cam lever 28 pulls up on the round strut washer 21 locking the clamp block 2 in place against the T-channel of the strut channel 24.

Figure 27:
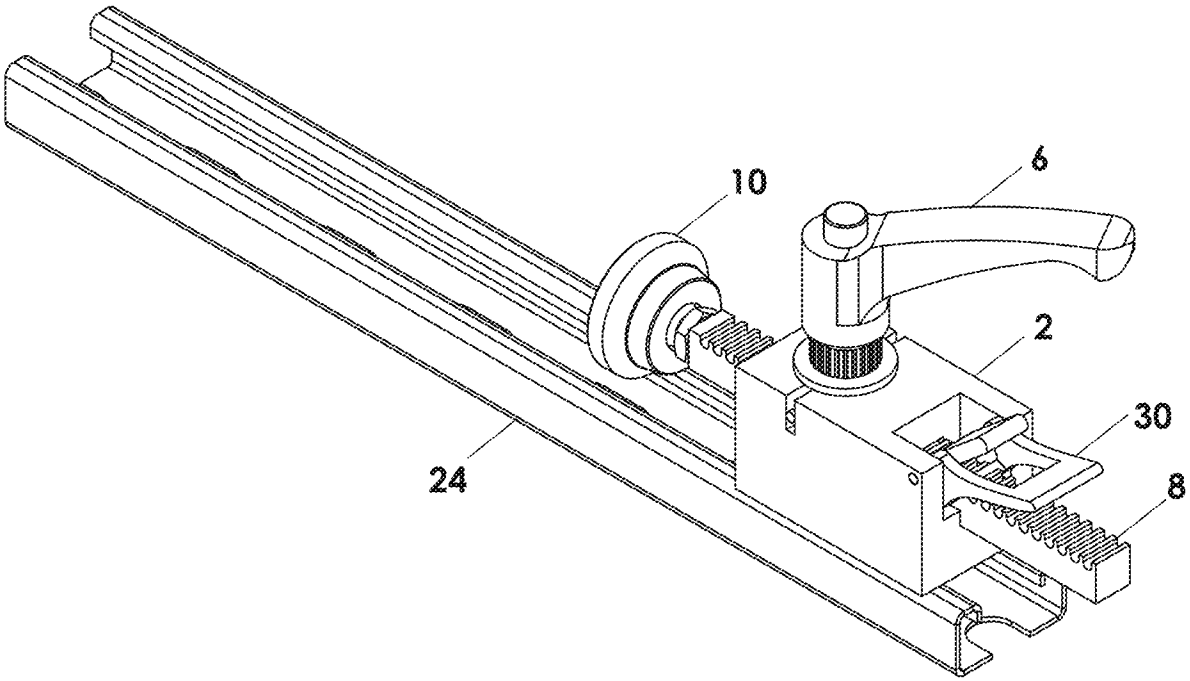
FIG. 27 illustrates an embodiment that includes a ratchet/pawl mechanism to advance the clamping shaft and produce the clamping force.

FIG. 27 illustrates an embodiment that includes a ratchet/pawl mechanism 30 to advance the clamping shaft 8 and produce the clamping force.

Other General Aspects of the Invention

General Aspect 2: Linear Actuator Using a Strut Channel

Figure 28:
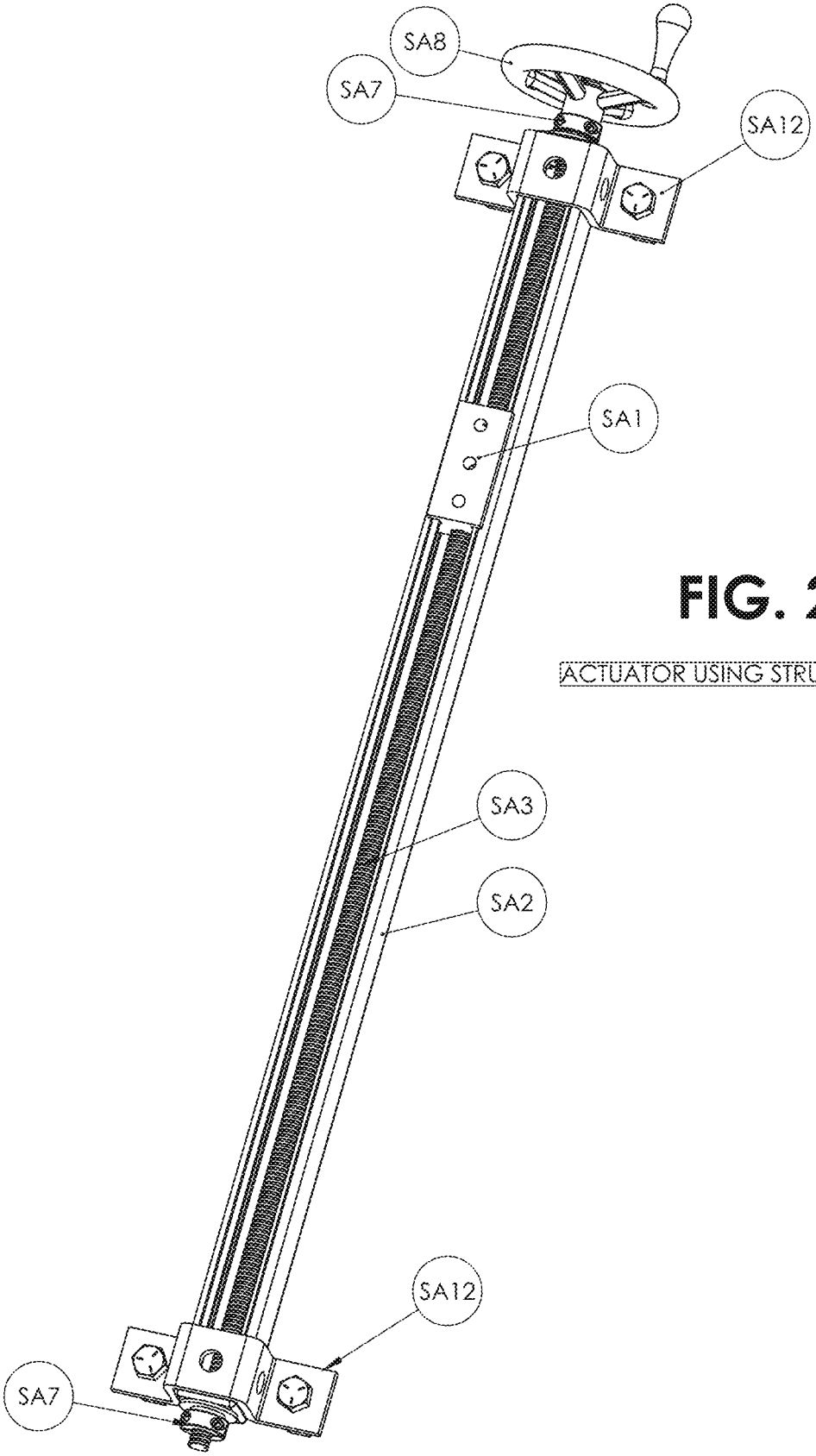
FIG. 28 is a complete linear actuator using a strut channel.

Description:

FIG. 28 is the complete linear actuator using a strut channel. The advantage of this linear actuator is its' use of commercially available strut channel. Some of the manufactures of the strut channel and accessories are, but not limited to: Super Strut, Unistrut, B-Line and PHD. The advantage of using the strut channel components is that no welding is required and a person can simply bolt the pieces together using common tools. Both the channel and accessories are available in home improvements stores worldwide.

Figure 29:
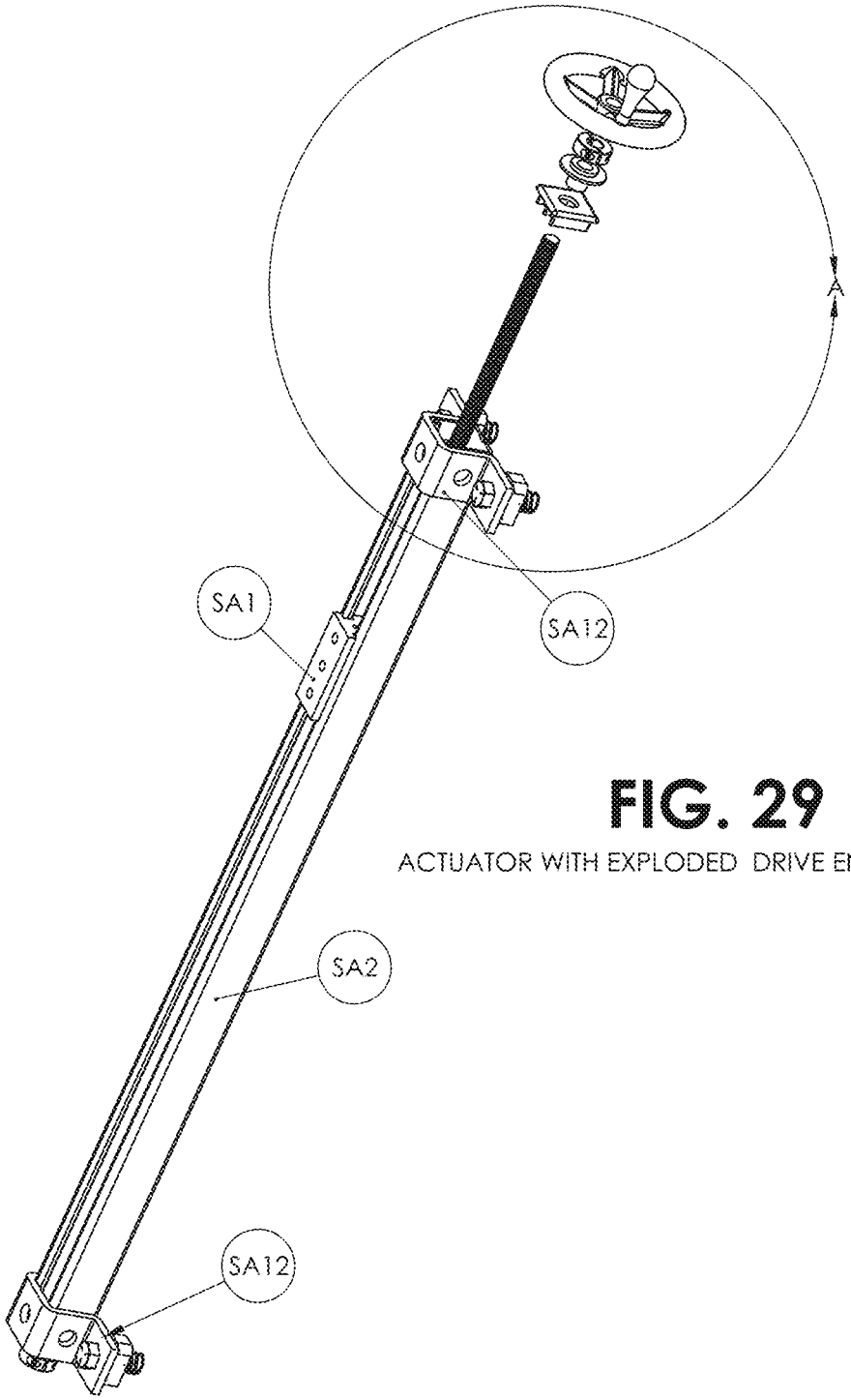
FIG. 29 shows an overall view of the linear actuator of FIG. 28 with the drive end exploded out showing the parts of the bearing assembly.

FIG. 29 shows the full view of the linear actuator. The main components of the linear actuator are: The strut channel (SA2), carriage block (SA1), the threaded screw/lead screw (SA3), end cap bearing assembly (parts SA4, SA5, SA6, SA7), hand wheel (SA8) and the linear actuator mounting brackets (SA12).

Figure 33:
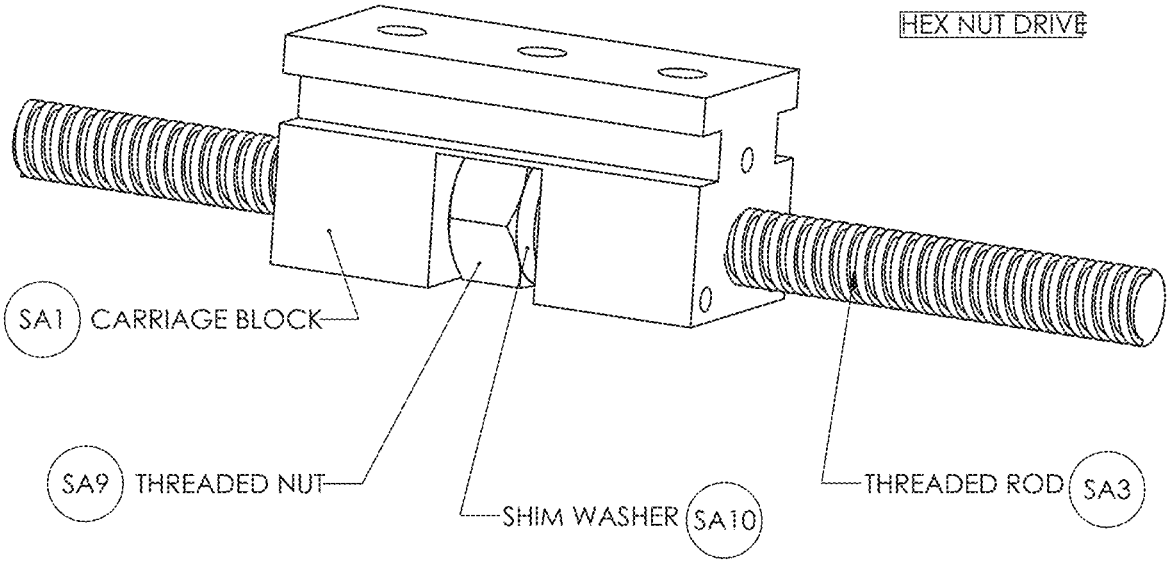
FIGS. 33 through 35 illustrate a means of driving the carriage block.
Figure 34:
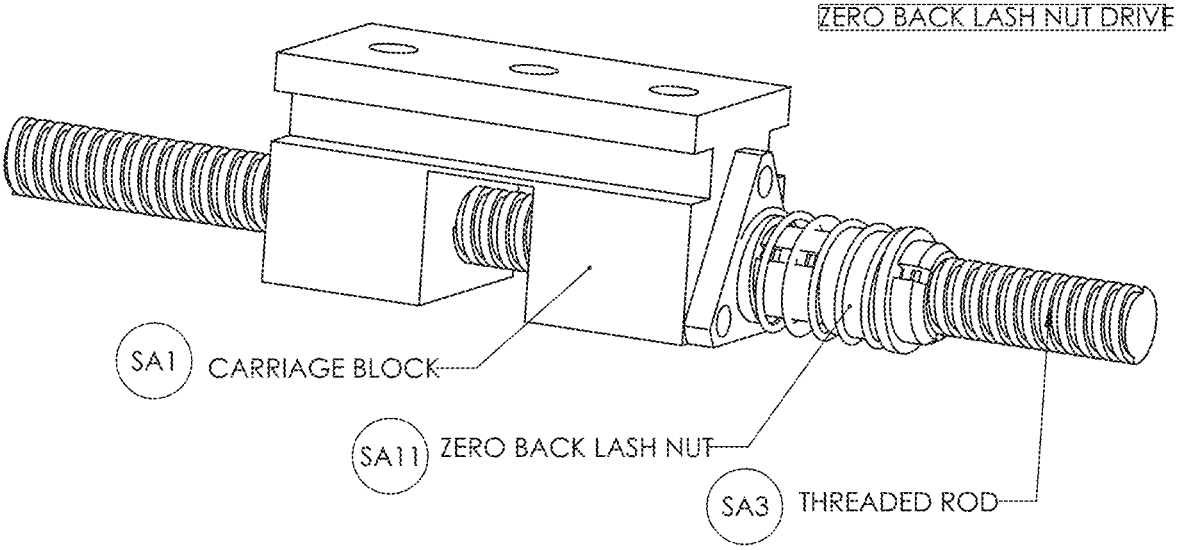
Figure 35:
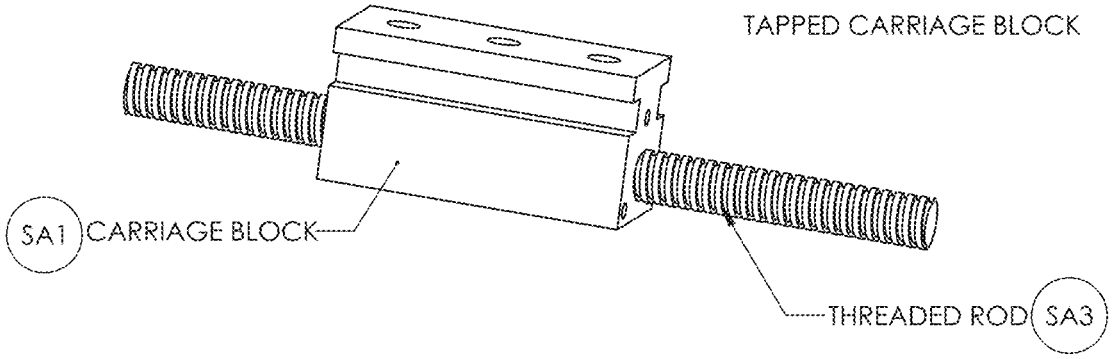

The means of driving the carriage block is shown in FIG. 33, FIG. 34 and FIG. 35. In FIG. 33, the carriage block is powered/moved by a captive nut (SA9) that is the female threaded match of the shaft (SA3). A thrust washer (SA10) is placed between the nut and the carriage block to allow an adjustment in fit/backlash. Other style nuts can also be substituted in place of the nut and washer. For a zero backlash application, FIG. 34 shows an alternative to the captive threaded nut. In this view, a special zero backlash lead screw nut (SA11) is mounted on the end of the carriage block (SA1). The respective threaded screw/lead screw shaft is used (SA3). In FIG. 35, a tapped hole in the carriage block (SA1) is matched with its respective screw.

FIGS. 30A and 30B shows the relationship of the carriage block (SA1) and the strut channel (SA2). The carriage block (SA1) has grooves that clear the upper bent edges of the strut channel. The upper section of the carriage block (SA1) supports/guides itself along the open end of the strut channel. The lower half of the carriage block has a through hole through its length where the threaded screw/lead screw (SA3) passes through. The ends of the lead screw extend past the ends of the strut channel (SA2). On each end of the strut channel are bearing assemblies that support the threaded screw/lead screw. FIG. 29 shows the overall view of the linear actuator with the drive end exploded out showing the parts of the bearing assembly. In this case, the end bearing assembly has a hand wheel (SA8) that requires an operator to manually rotate/crank the hand wheel (SA8) to induce motion to the carriage block.

FIG. 31 shows a detail view of the bearing assembly typical of the ends of the strut channel. In this view, the end bearing assembly has a hand wheel (SA8). Each end of the linear actuator has a standard strut channel bracket (SA12) which is available from most of the strut channel system manufacturers.

The end bearing assemblies consist of: A strut end cap (SA4) that has a hole through the center of it. This allows a flange bushing (SA5) to be pressed into it. A thrust washer (SA6) is placed under the flange of the said flange bushing (SA5) to take thrust loads when advancing the threaded screw. To keep the entire assembly in place, a shaft collar (SA7) is placed on each end of the threaded screw/lead screw (SA3). As seen in FIG. 31, a hand wheel (SA8) is added on one end to allow manual operation. Other means of inducing power to the drive end can also be used (motor, pulley, gears, etc.)

Figure 32:
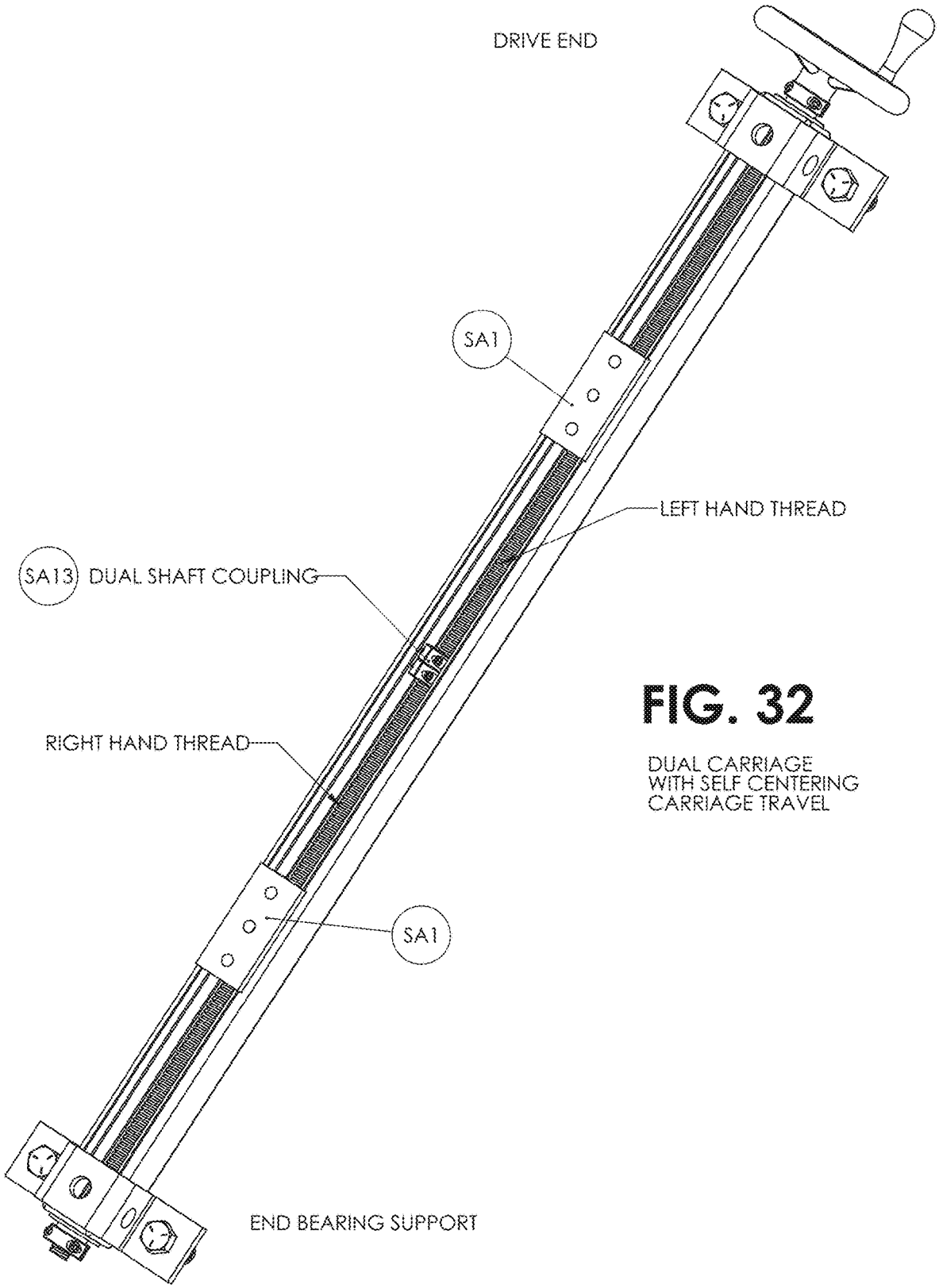
FIG. 32 shows an additional option for the same type of linear actuator as FIG. 28.

FIG. 32 shows an additional option for the same type of linear actuator. This mechanism is known as a self-centering mechanism. In this view, two opposite threaded screws/lead screws are coupled together in the center of the strut channel by and extended shaft collar (SA13). The two individual carriage blocks have the respective threaded nut of which the threaded screw/lead screw passes through. The operator turns/cranks the hand wheel (SA8) which turns the threaded screw which then induces a travel/motion to each of the carriage blocks. One direction of the hand wheel causes the carriage blocks to move toward each other while the opposite rotation will result in the carriage blocks moving away from each other.

Figure 36:
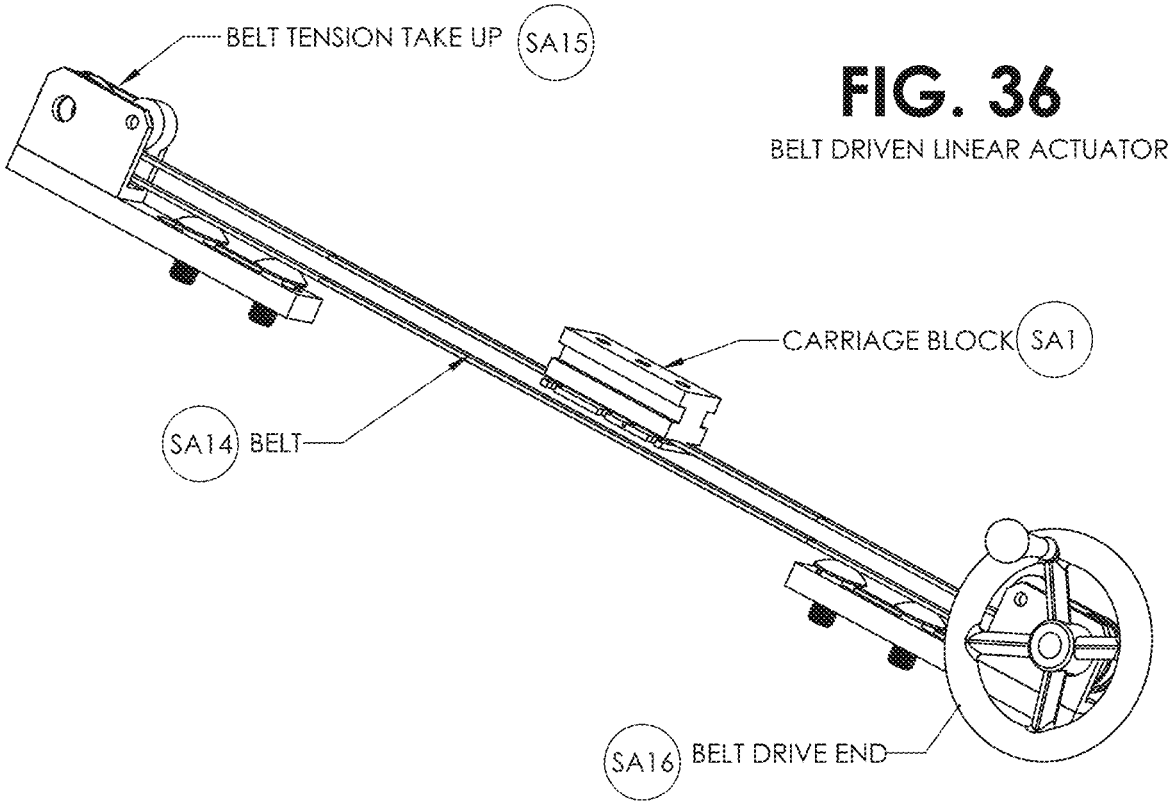
FIG. 36 is a belt driven version of the linear actuator.

FIG. 36 is a belt driven version of the linear actuator. In FIG. 36 the strut channel is not displayed in order to show the drive belt details. The drive belt (SA14) is attached to the carriage (SA1). On one end is the belt take up (SA15) which is used to take up the belt slack. The belt drive end (SA16) is similar in function as belt the take up (SA15) with the exception that it has an extended drive input shaft where a handwheel or other rotational input device is attached to.

Operation:

Screw Linear Actuator:

As mentioned above in the detailed description, the linear actuator is activated by an input to the end of the extended threaded screw/lead screw (SA3) on the drive end. The input can be a hand wheel (SA8), pulley, gear, motor, or other power supplied device. Turning the threaded screw/lead screw imparts a rotation inside the captive nut (SA9) of the carriage block (SA1). Because the captive nut is kept from rotating via the carriage block structure, the carriage block then moves along the length of the strut channel (SA2).

Belt Linear Actuator:

As mentioned above in the detailed description, the belt linear actuator is activated by an input to the belt drive end (SA16). The input can be a hand wheel (SA8), pulley, gear, motor, or other power supplied device. Turning the handwheel results in the belt (SA14) pulling the carriage block (SA1) along the length of the strut channel.

General Aspect 3: Strut Channel Panel Saw

Figure 37:
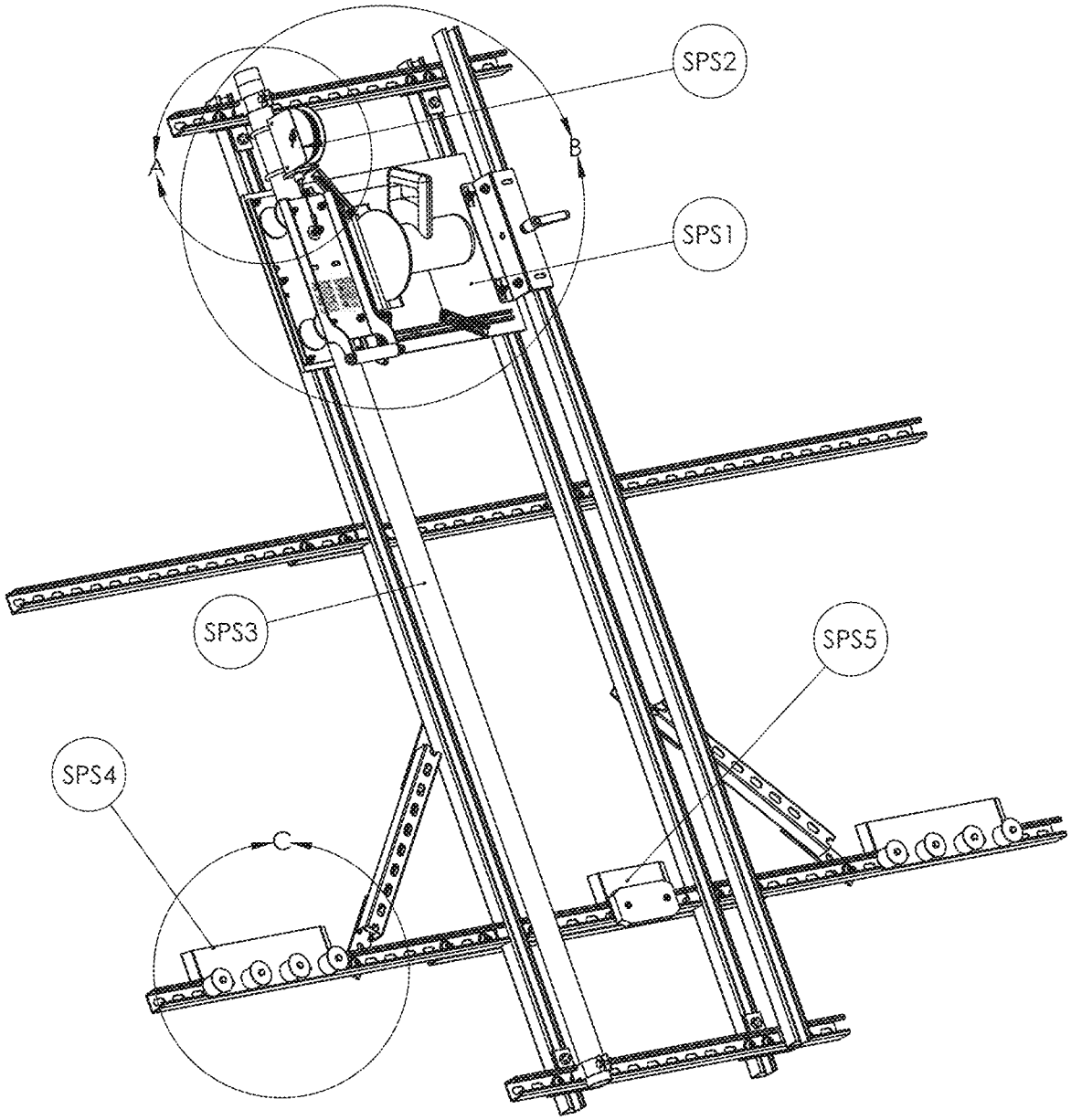
FIG. 37 is a complete strut channel panel saw.

Description:

FIG. 37 is the complete panel saw assembly. The construction of this panel saw is primarily made from commercially available strut channel. Some of the manufactures of the strut channel and accessories are, but not limited to: Super Strut, Unistrut, B-Line and PHD. The advantage of using the strut channel components is that no welding is required and a person can simply bolt the pieces together using common tools. Both the channel and accessories are available in home improvements stores worldwide.

The panel saw has five major components. These components mount to strut channel and other strut accessories. FIG. 37 shows the main components:

The saw carriage (SPS1) is made of three parts. These are the guide roller mount channels (SPS6), the side angle support (SPS8) and the saw mount base (SPS9). These are shown in detail in FIG. 40.

The counter balance (SPS2) is mounted to a plate that is secured to the guide shaft (SPS3) using "U" style bolts. The counter balance is a wrap spring/continuous force mechanism. A dead weight counter weight could also be used. The counter balance helps the operator raise the saw carriage back up to the top when a saw cut is complete.

The guide shaft (SPS3) is a common pipe that is matched with profile of the four "U" profile guide rollers (SPS7) shown in FIG. 40 that guide the carriage along the guide shaft. The ends of the guide shaft/pipe is secured to the top and bottom of the strut channel frame using standard pipe hangers.

Figure 41A:
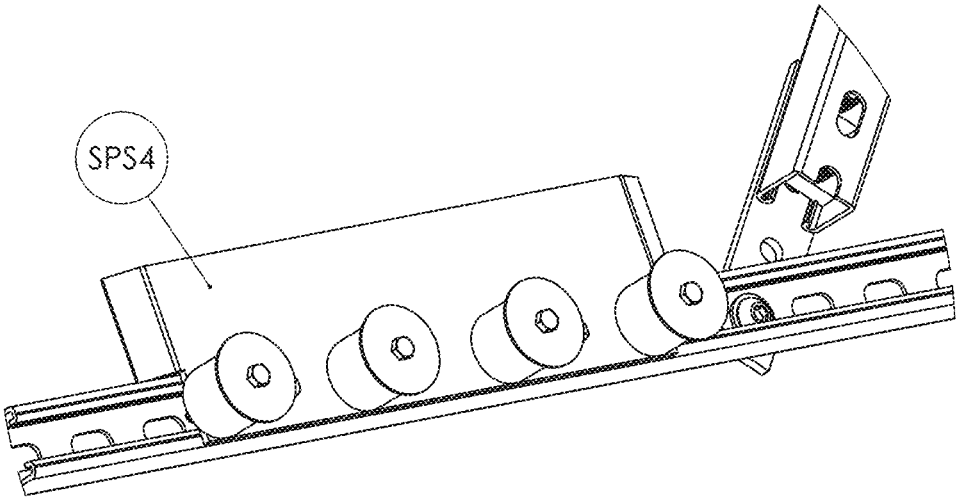
FIGS. 41A and 41B show a detail of the panel support roller assembly of FIG. 37.
Figure 41B:
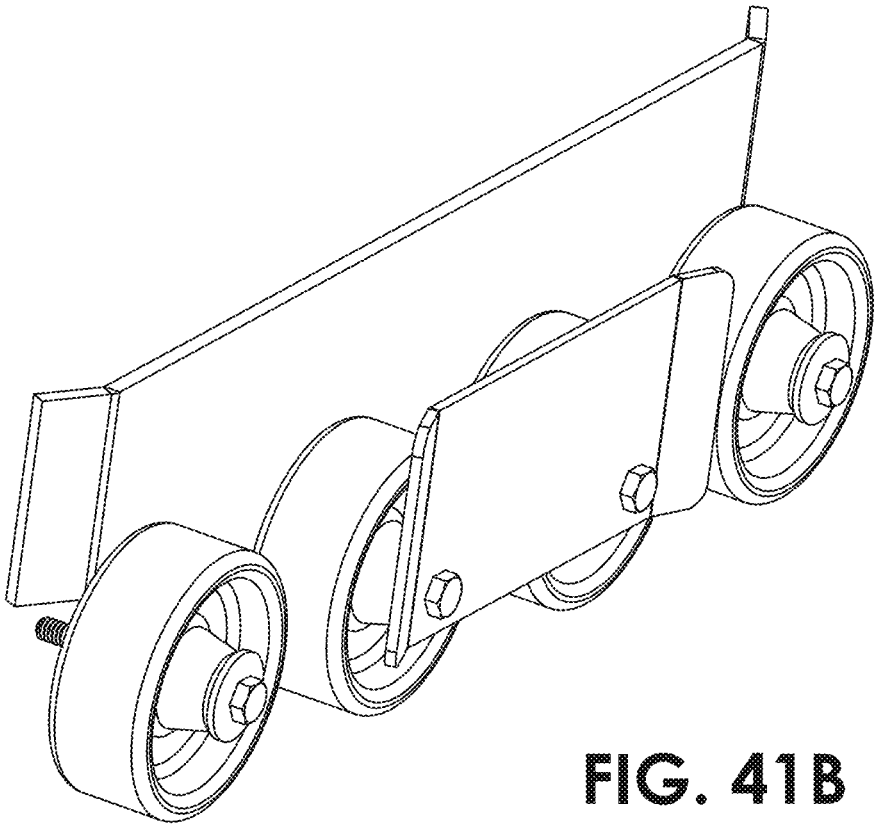

There are two or more panel support roller assemblies (SPS4) that mount to the bottom of the strut channel frame. These assemblies help support a wooden board and allow the wood to be pushed along the rollers so that an operator can position the board where the cut needs to be performed. These are shown in FIGS. 41A and 41B.

The center support guide (SPS5) is an additional support that is low in profile and clears the saw carriage when the saw carriage passes over the center support guide (SPS5)

Figure 38:
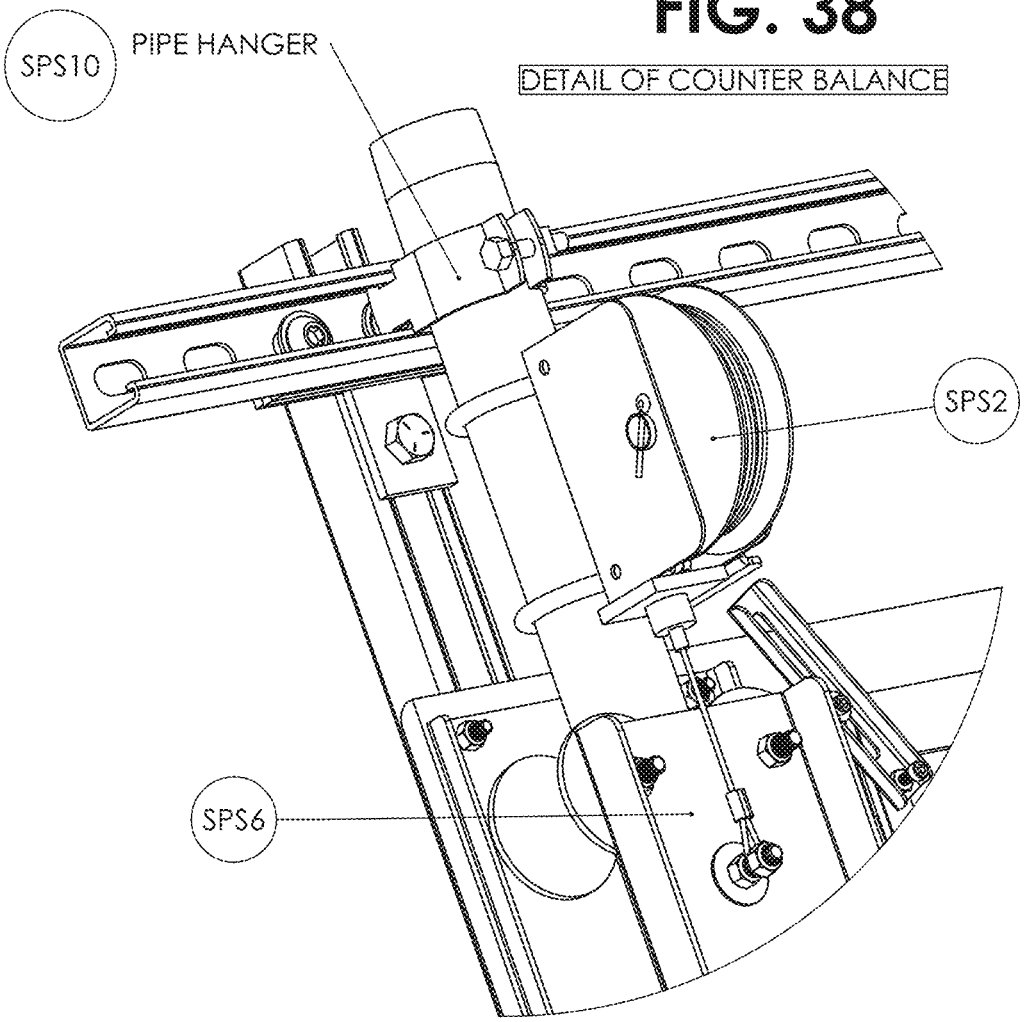
FIG. 38 shows a detail of the counter balance (SPS2) and how it is mounted to the guide shaft/pipe (SPS3) and to the saw carriage.

FIG. 38 shows a detail of the counter balance (SPS2) and how it is mounted to the guide shaft/pipe (SPS3) and to the saw carriage. The counter balance is a wrap spring/continuous force spring mechanism. A metal cable is wrapped around the spool of the mechanism. The end of the cable has a loop that hooks onto the roller mount cannel (SPS6). The guide shaft/pipe is mounted using standard pipe hangers (SPS10). The counter balance is mounted to the guide shaft/pipe using "U" bolts. This allows the operator to position the saw carriage and counter balance in the best position.

FIGS. 39 and 40 shows details of the saw carriage. The base of the carriage (SPS9) is made of wood which allows the operator to customize the carriage to suit his brand of hand circular saw. The upper and lower roller mount channels (SPS6) secure the "U" profile guide rollers (SPS7) and provides a rigid structure for mounting the wooden carriage base (SPS9). The upper roller mount plate has an integrated handle (SPS11) that the operator uses to pull the carriage down while making a saw cut. The side angle guide (SPS8) supports the end opposite the roller mount channel assembly. It also has a hand lock that allows the operator to lock the saw carriage in position if required.

FIGS. 41A and 41B show a detail of the panel support roller assembly. The wheels are mounted on a plate that has a bend on each end. These bends rest on the side of the strut channel that these assemblies mount to. The bends help carry the weight of the wooden boards as they rest of the support roller assemblies.

Operation:

The operator loads a wooden board/panel on the two roller support assemblies (SPS4). The board is positioned behind the guide shaft (SPS3) and saw carriage (SPS1). The operator then places his hand on the circular saw handle and turns on the saw. With one hand on the saw and the other pulling down on the roller support channel handle (SPS11), the saw is moved all the way down to the bottom of the support roller assemblies. Once passing the edge of the board where it makes contact with the rollers. The board then is cut. The operator then raises he saw carriage with the help of the counter balance (SPS2).

General Aspect 5: Strut Channel Folding Bench

Figure 42:
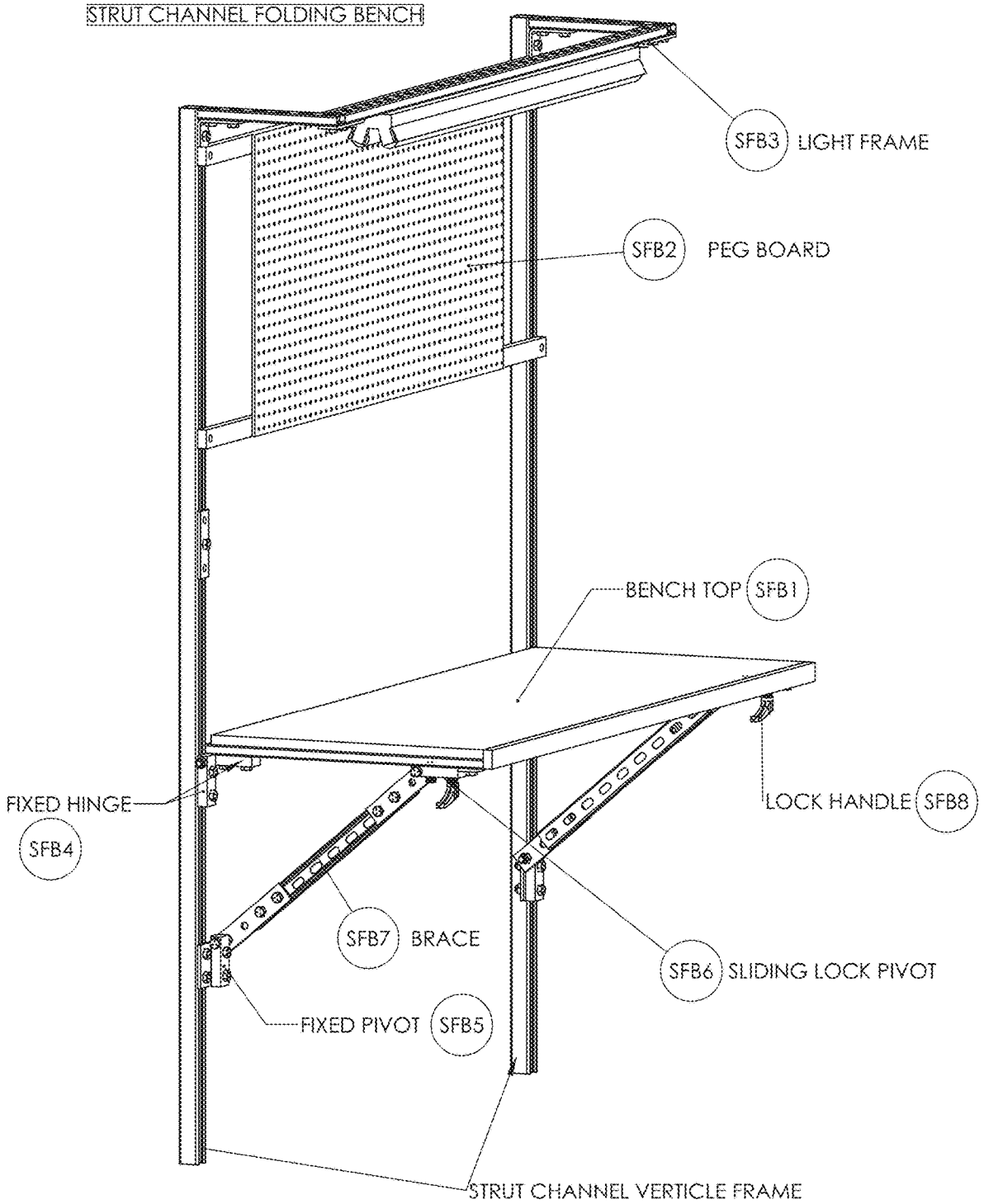
FIG. 42 is a strut channel folding bench shown in its folded "down" position.
Figure 43:
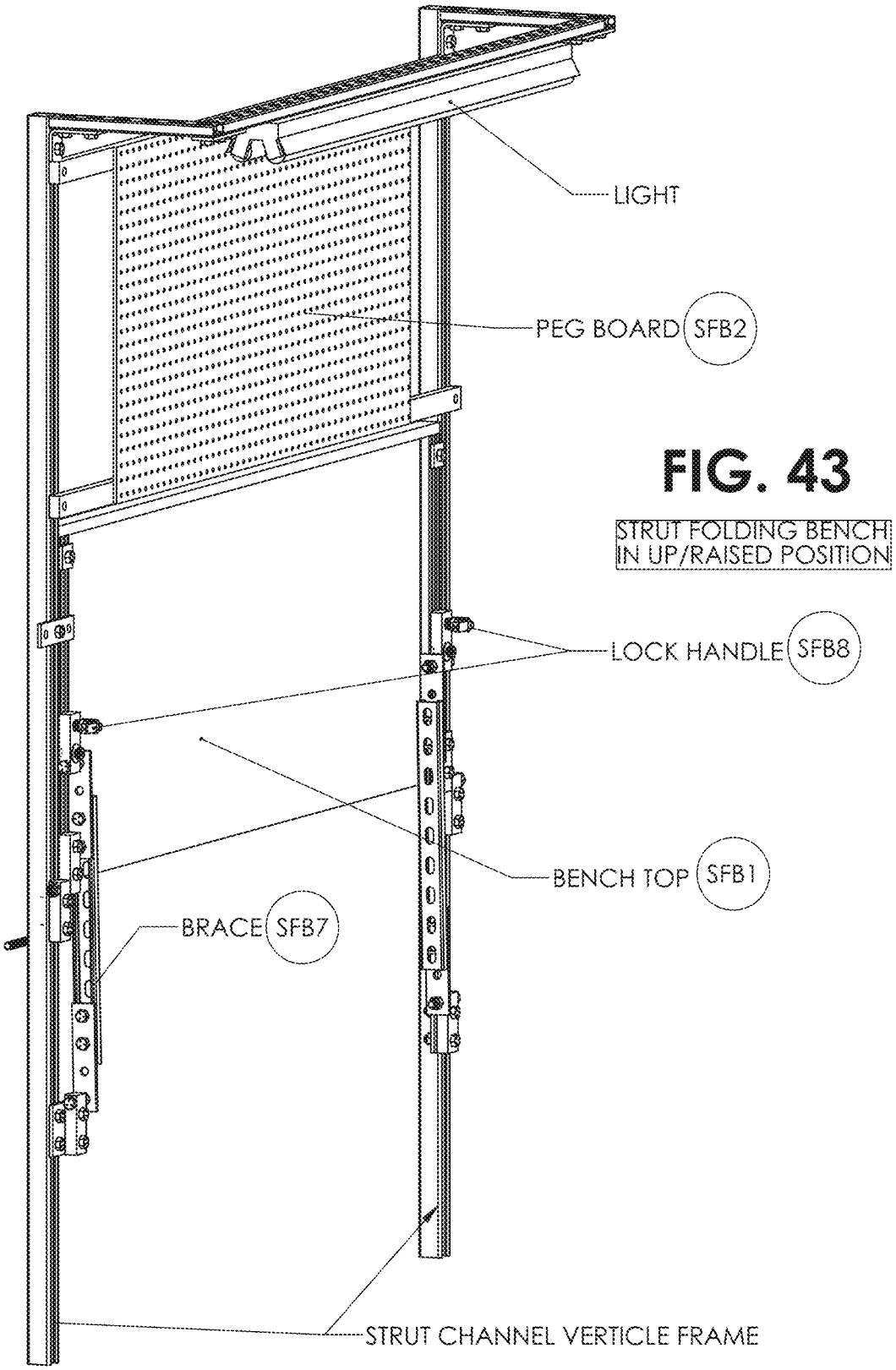
FIG. 43 is a view of the bench of FIG. 42 shown in its folded "up" position.
Figure 44:
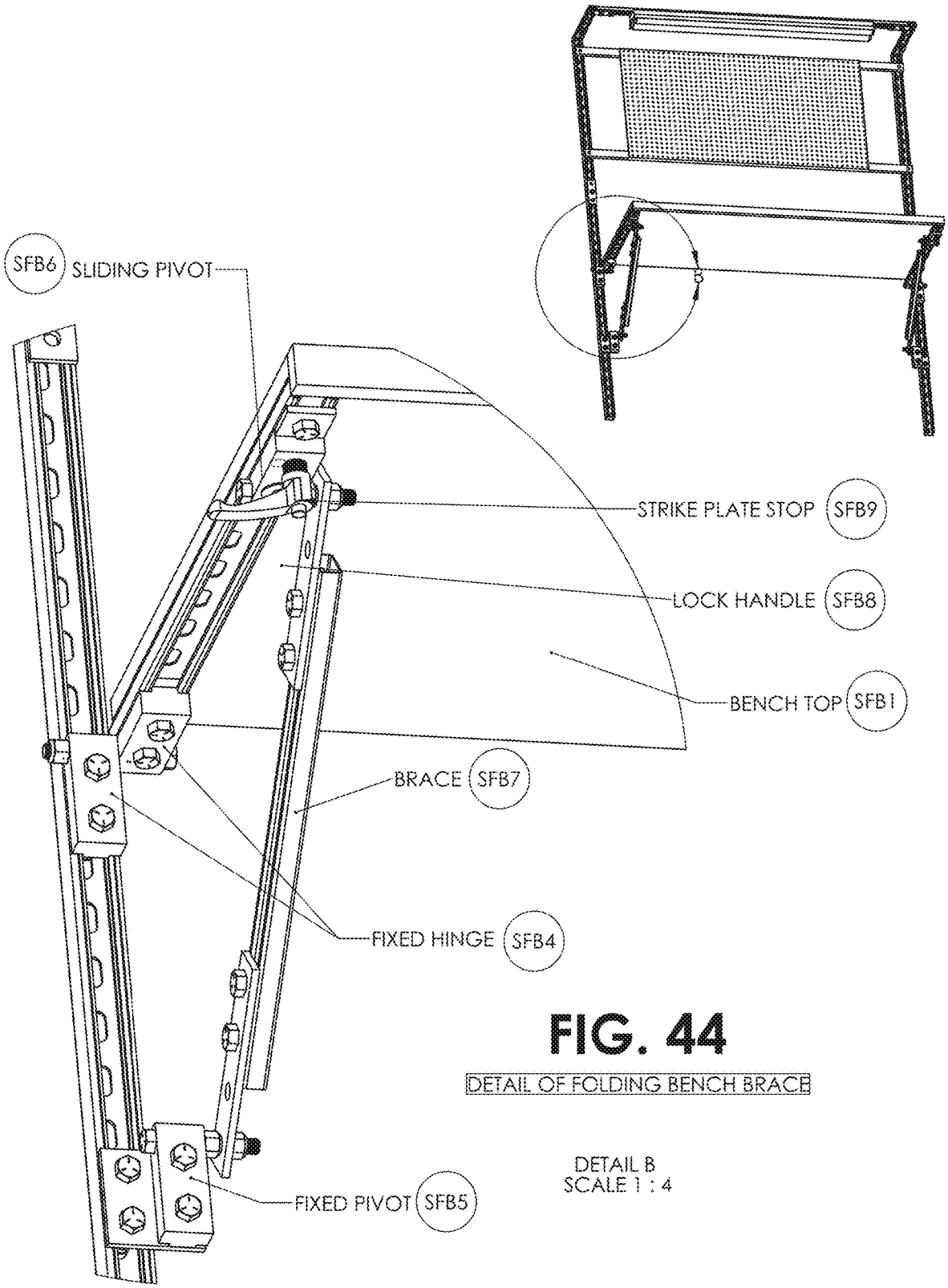
FIG. 44 shows a view looking under the bench top when the bench top is in its' folded down" position.

Description:

FIG. 42 is the bench in its folded "down" position. The construction of this bench is primarily made from commercially available strut channel. Some of the manufactures of the strut channel and accessories are, but not limited to: Super Strut, Unistrut, B-Line and PHD. The advantage of using the strut channel components is that no welding is required and a person can simply bolt the pieces together using common tools. Both the channel and accessories are available in home improvements stores worldwide. There can be many versions of this bench. In this version, there is a folding bench top (SFB1), a peg board to organize tools (SFB2) and a frame to mount a fluorescent light fixture (SFB3). All these components are made using strut channel and some custom parts. The bench top in FIG. 42 pivots about a fixed hinge (SFB4) on either end of the top. Below this is a fixed pivot (SFB5) that mounts one end of the brace. The other end of the brace is secured to the sliding pivot lock (SFB6). This sliding lock is able to slide along the open side of the strut channel that is mounted to the bottom of the bench top on each side. FIG. 43 is the bench in its folded "up" position. The bench top is folded up and rest in a position just below the peg board and even with the strut channel vertical frame. FIG. 44 shows a view looking under the bench top when the bench top is in its' folded down" position. A larger detail on the bottom of the page shows the orientation of the fixed hinge, fixed pivot and the brace (SFB7). The sliding pivot lock (SFB6) has a groove on the bottom of the block that keeps the block in line with the strut channel.

Operation:

The method of operation is very simple. The person loosens the two (SFB2) lock handles (SFB8) located under each end of the bench top. After each lock is released, the person lifts up the bench top (SFB1) (with 2 hands) in the center of the bench top. The bench top is raised and set in a position 90 degrees from its original position. The lock handles (SFB8) are then locked so that the bench does not drop back down to its "down" position. When in the "down" position, the sliding pivot locks rest against a strike plate stop (SFB9) (FIG. SFB-3). These take the force of the bench top when in the down position and also allows a person to adjust the stop position of the sliding pivot locks so to maintain a bench top position horizontal to the floor.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application. This specification is not intended to be exhaustive or to limit the invention to the precise form disclosed. Many modifications and variations are possible in light of this disclosure.

Although the present application is shown in a limited number of forms, the scope of the invention is not limited to just these forms, but is amenable to various changes and modifications without departing from the spirit thereof. The disclosure presented herein does not explicitly disclose all possible combinations of features that fall within the scope of the invention. The features disclosed herein for the various embodiments can generally be interchanged and combined into any combinations that are not self-contradictory without departing from the scope of the invention. In particular, the limitations presented in dependent claims below can be combined with their corresponding independent claims in any number and in any order without departing from the scope of this disclosure, unless the dependent claims are logically incompatible with each other.

I claim:

1. A clamp configured for operation while attached to an elongated structural member having a uniform cross sectional shape along its longitudinal axis, the structural member including a longitudinal slot that is open to an upper surface of the structural member, said slot being widened below the upper surface of the structural member so that the slot is covered by a slot overhang on each side thereof, the clamp comprising:

a clamp stop attached to the structural member, the clamp stop including a stop surface at its proximal end that is substantially perpendicular to the longitudinal axis of the structural member; and a clamp block assembly comprising:

a clamp housing penetrated by a first vertical hole intersected by a horizontal passage;

a fixing pin inserted in the first vertical hole, the fixing pin including a vertically extended hole that is held in alignment with the horizontal passage of the clamp housing;

a slot key that is horizontally insertable into the slot of the structural member, a lower portion of the slot key being sufficiently wide to prevent vertical removal of the slot key from the slot while an upper portion of the slot key extends vertically through the slot and is attached to a distal end of the fixing pin, the clamp housing being thereby slidably attached to the structural member;

a lifting mechanism configured to apply a lifting force to the fixing pin, thereby forcing the slot key vertically upward against the slot overhang and fixing the clamp housing in position along the structural member; and a clamping shaft extending through the horizontal passage and engaged therewith, whereby the clamping shaft can be disengaged or otherwise manipulated for advancement and retraction through the horizontal passage; and a block surface fixed to a distal end of the clamping shaft and substantially perpendicular to the longitudinal axis of the structural member, so that the block surface can be placed in an opposed, parallel relationship to the stop surface when the clamping shaft is parallel to the longitudinal axis of the structural member and the block surface is directed toward the clamp stop.

2. The clamp of claim 1, wherein the lifting mechanism includes a lever that can be actuated so as to apply the lifting force.

3. The clamp of claim 1, wherein the lifting mechanism includes a rotatable member in threaded engagement with a proximal end of the fixing pin, so that rotation of the rotatable member applies the lifting force.

4. The clamp of claim 3, wherein rotatable member is cooperative with a manually operable handle.

5. The clamp of claim 1, wherein the slot key is attached to the distal end of the fixing pin by threaded engagement.

6. The clamp of claim 1, further comprising a plurality of replacement fixing pins configured for interchangeable attachment to the distal end of the fixing pin so as to adapt the clamp block assembly for attachment to structural members having slots with respectively differing profile shapes.

7. The clamp of claim 1, wherein the clamp housing can be rotated about the fixing pin when the lifting force is released.

8. The clamp of claim 1, further comprising an orienting pin extending downward from the clamp housing into the longitudinal slot, thereby maintaining the horizontal passage in parallel alignment with the longitudinal slot.

9. The clamp of claim 8, wherein the orienting pin is retractable, thereby enabling rotation of the clamp housing about the fixing pin when the lifting force is released.

10. The clamp of claim 1, wherein the clamping shaft is engaged with the horizontal passage by a ratchet or pawl mechanism.

11. The clamp of claim 1, wherein the clamping shaft is a threaded shaft and the horizontal passage is a threaded passage, so that the clamping shaft can be advanced and retracted through the threaded passage by rotation and counter-rotation of the threaded shaft, respectively.

12. The clamp of claim 1, wherein:

the clamping shaft is a threaded shaft;

the clamp housing includes a second vertical hole intersecting the horizontal passage;

the clamp further comprises a spring resting on a bottom of the second vertical hole, and a thread-engaging mechanism resting on the spring in the second vertical hole, the thread-engaging mechanism including a partially-threaded, vertically elongated hole aligned with the horizontal passage and configured to engage with the threaded shaft when the spring is not compressed, and to release the threaded shaft when the spring is compressed.

13. The clamp of claim 1, wherein a location of attachment of the clamp stop to the structural member can be selected from among a plurality of available attachment locations on the structural member.

14. The clamp of claim 1 wherein the clamp is configured for attachment to a structural member that is a T-slot strut channel formed by folding of a metal sheet.

15. The clamp of claim 1, wherein the clamp is configured for attachment to a structural member that is a slotted extrusion.

16. The clamp of claim 1, wherein the clamp housing extends into the longitudinal slot, thereby maintaining an alignment between the clamp housing and the longitudinal slot.

* * * * *